US010465375B2

(12) United States Patent
Fay et al.

(10) Patent No.: US 10,465,375 B2
(45) Date of Patent: Nov. 5, 2019

(54) DEMOUNTABLE/MODULAR STRUCTURE SYSTEM

(71) Applicant: Lada Cube, LLC, Grand Junction, CO (US)

(72) Inventors: John Fay, Grand Junction, CO (US); Jeff Jacobson, Grand Junction, CO (US)

(73) Assignee: LADA CUBE, LLC, Grand Junction, CO (US)

( * ) Notice: Subject to any disclaimer, the term of this patent is extended or adjusted under 35 U.S.C. 154(b) by 0 days.

(21) Appl. No.: 15/981,882

(22) Filed: May 16, 2018

(65) Prior Publication Data

US 2018/0334798 A1 Nov. 22, 2018

Related U.S. Application Data

(63) Continuation-in-part of application No. 15/014,734, filed on Feb. 3, 2016, now abandoned.

(Continued)

(51) Int. Cl.
*E04B 2/00* (2006.01)
*E04B 1/343* (2006.01)

(Continued)

(52) U.S. Cl.
CPC ..... *E04B 1/34321* (2013.01); *E04B 1/34384* (2013.01); *E04B 1/7662* (2013.01); *E04B 1/8209* (2013.01); *E04B 1/99* (2013.01); *E04B 7/12* (2013.01); *E04C 2/3405* (2013.01); *E04C 2/46* (2013.01); *E04C 2/52* (2013.01); *E04B 1/8218* (2013.01); *E04B 7/20* (2013.01); *E04C 2002/004* (2013.01)

(58) Field of Classification Search
CPC ..... E04B 1/34321; E04B 1/8218; E04B 7/12; E04B 1/6145; E04B 1/6162; E04B 1/6166; E04B 1/617; E04B 1/6179; E04B 1/9183; E04C 2/46; E04C 2/52; E04C 2/3405; E04C 2002/004
USPC ..... 52/2.22
See application file for complete search history.

(56) References Cited

U.S. PATENT DOCUMENTS 2,647,287 A * 8/1953 Jones ..... E04B 1/34321 108/55.1
3,343,314 A * 9/1967 Smith ..... E04B 1/8218 52/145

(Continued)

*Primary Examiner* — Daniel J Troy
*Assistant Examiner* — James J Buckle, Jr.
(74) *Attorney, Agent, or Firm* — Snell & Wilmer LLP

(57) ABSTRACT

A demountable structure system is disclosed. The demountable structure system may have a roof system positioned atop one or more structural panel(s) and a floor system positioned beneath one or more structural panels(s). The structural panels may have different shapes, configurations, and features, and may support the roof system in order to form a demountable structure. Alternatively, the roof system is omitted and a wall or other structure can be formed from the structural panels. Each structural panel may have other features, such as finish panels, fabric panels, accessory mounts, recessed lighting, electrical outlets, etc. Some structural panels have sound dampening features, such as to form portable musician's sound booth. Thus, a structure may be formed which is both readily disassembled, yet also sturdy.

20 Claims, 41 Drawing Sheets

Related U.S. Application Data

(60) Provisional application No. 62/111,512, filed on Feb. 3, 2015.

(51) Int. Cl.

| | |
|---|---|
| ***E04B 1/99*** | (2006.01) |
| ***E04B 7/12*** | (2006.01) |
| ***E04C 2/52*** | (2006.01) |
| ***E04B 1/76*** | (2006.01) |
| ***E04B 1/82*** | (2006.01) |
| ***E04C 2/34*** | (2006.01) |
| *E04B 7/20* | (2006.01) |
| *E04C 2/00* | (2006.01) |

(56) References Cited

U.S. PATENT DOCUMENTS 3,353,314 A * 11/1967 Melcher ..... E04B 1/6183 52/127.9
3,365,223 A * 1/1968 Bisbing ..... E04B 1/6183 292/111
3,365,851 A * 1/1968 Cushman ..... E04B 1/6183 52/127.9
3,392,497 A * 7/1968 Cushman ..... E04B 1/6183 52/241
3,421,459 A * 1/1969 Sherwood ..... A47B 83/001 108/13
3,712,653 A * 1/1973 Lehmann ..... E04B 1/6183 292/111
3,826,056 A * 7/1974 Smith ..... E04B 1/6183 52/582.2
4,417,430 A * 11/1983 Loikitz ..... E04B 1/6183 292/111
4,507,010 A * 3/1985 Fujiya ..... E04B 1/6183 292/98
4,512,122 A * 4/1985 Berkowitz ..... E04B 1/6183 29/453
5,323,564 A * 6/1994 Mensching ..... A63J 1/02 52/127.9
5,424,118 A * 6/1995 McLaughlin ..... E04B 1/6183 428/314.8
5,768,829 A * 6/1998 Thompson ..... E04B 1/34321 52/86
5,921,047 A * 7/1999 Walker ..... E04B 1/6141 52/282.2
5,927,032 A * 7/1999 Record ..... E04C 2/292 52/284
6,029,831 A * 2/2000 Miller ..... E04B 2/7425 211/182
6,079,754 A * 6/2000 Alexy ..... E04B 1/6183 292/101
6,119,427 A * 9/2000 Wyman ..... E04B 1/12 52/127.11
6,299,224 B1 * 10/2001 Finkelstein ..... E04B 1/6183 292/240
6,363,661 B1 * 4/2002 Myers ..... E04H 15/20 52/2.13
8,286,399 B2 * 10/2012 Brown ..... E04B 1/14 52/404.4
8,528,288 B1 * 9/2013 Kinser, Jr. ..... E04B 1/6183 292/194
8,776,472 B1 * 7/2014 Kinser, Jr. ..... E04B 1/80 52/580
8,863,456 B2 * 10/2014 Nicolson ..... B05B 7/0433 52/309.12
2002/0189182 A1 * 12/2002 Record ..... E04C 2/288 52/309.9
2003/0033769 A1 * 2/2003 Record ..... E04B 1/14 52/270
2007/0094972 A1 * 5/2007 Hess ..... E04H 9/14 52/410
2008/0238109 A1 * 10/2008 Huang ..... E04B 1/6183 292/95
2009/0223144 A1 * 9/2009 Leahy ..... E04B 1/34321 52/79.1
2017/0081848 A1 * 3/2017 Finkelstein ..... E05C 19/12
2017/0121961 A1 * 5/2017 Hodson ..... E04B 1/34321
2017/0306610 A1 * 10/2017 Leahy ..... E04B 1/34321

* cited by examiner

DEMOUNTABLE/MODULAR STRUCTURE SYSTEM

CROSS REFERENCE TO RELATED APPLICATIONS

This application claims priority to and the benefit of U.S. application Ser. No. 15/014,734, filed on Feb. 3, 2016 and entitled "DEMOUNTABLE/MODULAR STRUCTURE SYSTEM," which claims priority to and the benefit of U.S. Provisional Patent Application No. 62/111,512 filed Feb. 3, 2015 entitled "DEMOUNTABLE/MODULAR STRUCTURE SYSTEM." The foregoing applications are incorporated herein by reference in their entireties.

FIELD OF INVENTION

The present invention relates to the field of temporary structures. More particularly, the present invention relates to a demountable panel system for constructing temporary structures.

BACKGROUND

Interior walls are used to divide buildings into segmented internal space, such as rooms. However, interior walls frequently require modification to the building structure in order to be secured in place. Moreover, soundproofing interior areas, especially, temporary spaces, frequently requires additional modification to the building structure, or the installation of semi-permanent fixtures. Furthermore, there is often a need for temporary outdoor shelters, such as at events and festivals. However, outdoor shelters capable of withstanding inclement weather often require extensive labor and structural anchoring. In addition, reconfiguration of the surface of walls, soundproofing, and shelters, such as with new paint, designs, sound dampening material, and the like, are labor-intensive and expensive. Thus there is a need for a demountable structure system that allows for the quick assembly and disassembly of temporary structures, temporary sound insulated structures, and temporary outdoor structures, and that allows for the quick reconfiguration of the surfaces and shape of the structure.

SUMMARY OF THE INVENTION

In accordance with various aspects of the present invention, a demountable structure system is disclosed. The demountable structure system may have a roof system positioned atop one or more structural panel(s) and a floor system positioned beneath one or more structural panel(s). The structural panels may have different shapes, configurations, and features, and may support the roof system in order to form a demountable structure. Alternatively, the roof system is omitted and a wall or other structure can be formed from the structural panels. Each structural panel may have other features, such as finish panels, fabric panels, accessory mounts, recessed lighting, electrical outlets, etc. Finish panels allow for the quick reconfiguration of the surfaces of the structural panels, such as by allowing color or aesthetic design changes, sound proofing, and cosmetic reconfigurations. Optional use of universal components allows reconfiguration of the overall shape and design of the demountable structure. Some structural panels have sound dampening features, such as to form portable musician's sound booth.

The structural panel may have a panel shape and may comprise one or more joining member(s), joining edge(s), finish panel attachment point(s), and may have an internal structure. The structural panel may have a length, thickness, and height. The joining edge may comprise one or more face(s) of the structural panel oriented to abut a corresponding face of one or more additional structural panel(s), so that the structural panels may be connected together. The joining edge may comprise a boss edge, or a boss receiving edge. The joining member may comprise a member configured to interoperate with the joining member of another structural panel to selectably prevent the structural panels from being separated. The joining edge may comprise a cam and/or a cam receiver. The internal structure may be an arrangement of panels, voids, and equipment inside the structural panel. Finish panel attachment points may comprise a bracket, clip, or other apparatus whereby a finish panel may be joined to the structural panel.

In accordance with various aspects of the present invention, the structural panels and/or roof system may be arranged to form a structure which is both readily disassembled, yet also sturdy.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

For the sake of brevity, conventional techniques for manufacturing and construction may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical method of construction.

Figure 1:
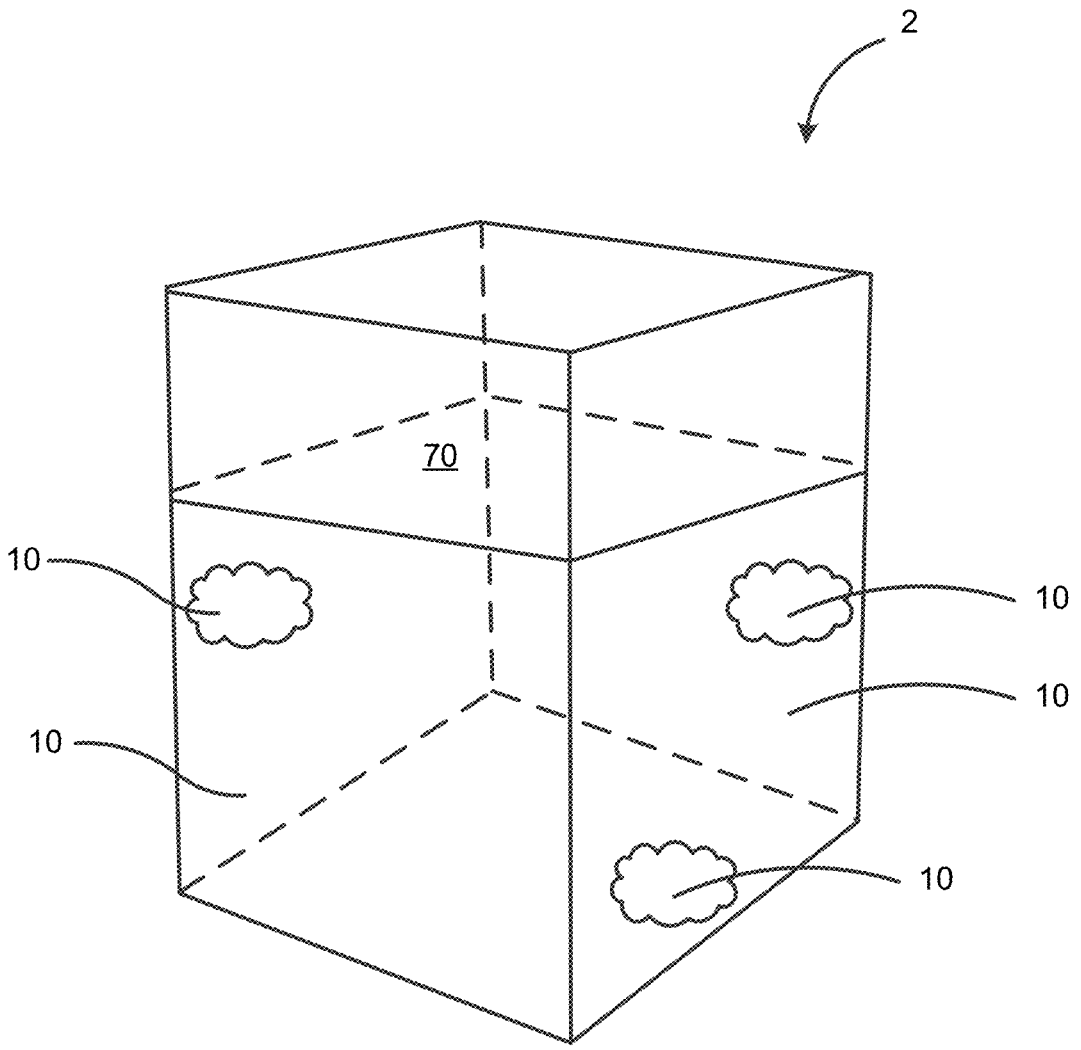
FIG. 1 is a block diagram of an example demountable structure system in accordance with various embodiments.

In accordance with various embodiments, and with reference to FIG. 1, a demountable structure system 2 may comprise a roof system 70 positioned atop one or more structural panel(s) 10. The structural panels 10 provide support to a roof system 70, and or a floor system 10, forming an enclosed demountable structure. Alternatively, the roof system 70 may be omitted and floor system 10 may be omitted and a wall or other structure can be formed from the structural panels 10. In accordance with further embodiments, and with reference to FIGS. 1-10G, a demountable structure system 2 (FIG. 1) may further comprise a combination of additional features such as finish panels 60, fabric panels 80, accessory mounts 90, recessed lighting 97, and electrical outlets 98. Some structural panels 10 have sound dampening features, such as to form portable a musician's sound booth, or other structure. In various embodiments, one or more such element(s) may be omitted. In further embodiments, any number of one or more such element(s) may be included in a demountable structure system 2. While certain example configurations are discussed herein, numerous features and embodiments of demountable structure system 2 may be achieved in accordance with various exemplary embodiments of the present invention.

In accordance with various embodiments, and with reference to FIGS. 1, 2, 3A-B, 6A-B, and 6E, a demountable structure system 2 may comprise one or more structural panel(s) 10. A demountable structure system 2 may further comprise structural panels 10 arranged to form an enclosure, such as a room, or a tent, or other structure. In various embodiments, a demountable structure system 2 comprises structural panels 10 joined together and arranged in various ways. For instance, a demountable structure system 2 may have structural panels 10 mountable between (but not permanently attached to) the floor and ceiling of a building. The demountable structure system 2 may comprise structural panels 10 arranged to form a free standing enclosure, or arranged to form a single free standing wall, or arranged to form a group of assembled walls with an attached assembled roof but no floor, or arranged to form a group of assembled walls with an attached assembled roof and with an attached floor, or any other desired arrangement.

With attention to FIGS. 1, 6A, 6B, and 6D-F, a demountable structure system 2 may further comprise one or more finish panel(s) 60. Finish panel 60 may be mounted to a face of the structural panel 10 to enhance the appearance, sound dampening, durability, or other characteristics of the demountable structure system 2. In demountable structure systems 2 having structural panels 10 arranged to form an enclosure, finish panels 60 may be arranged on the interior side (e.g., facing inward toward the center of the enclosure) of the structural panels 10. Finish panel 60 may be made of different materials. For instance, the finish panel 60 may be made from wood, metal, acrylic, artificial grass, drywall, fabric, sound dampening material and the like. As used throughout this disclosure, sound dampening material may comprise an acoustic spray comprising a soft rubber material, polyurethane putty, rock mineral fiber insulation batting, basalt rock, recycled slag material, vinyl stripping, recycled tire material, felt fabric, and/or any other material suitable for dampening sound waves. In other embodiments, the finish panel 60 may be made of metal such as reflective metal, glass such as colored glass, wood such as wooden slats, or any other material creating a desired effect and aesthetic. In various examples, the structural panels 10 may have a two-millimeter and up to 6-millimeter thick sound absorbing rubber membrane loaded vinyl layer on the interior facing face. To improve the visual appeal of the demountable structure system 2, one or more finish panel(s) made of a different material may be mounted on the interior side of the structural panels 10, hiding the vinyl layer.

Figure 7A:
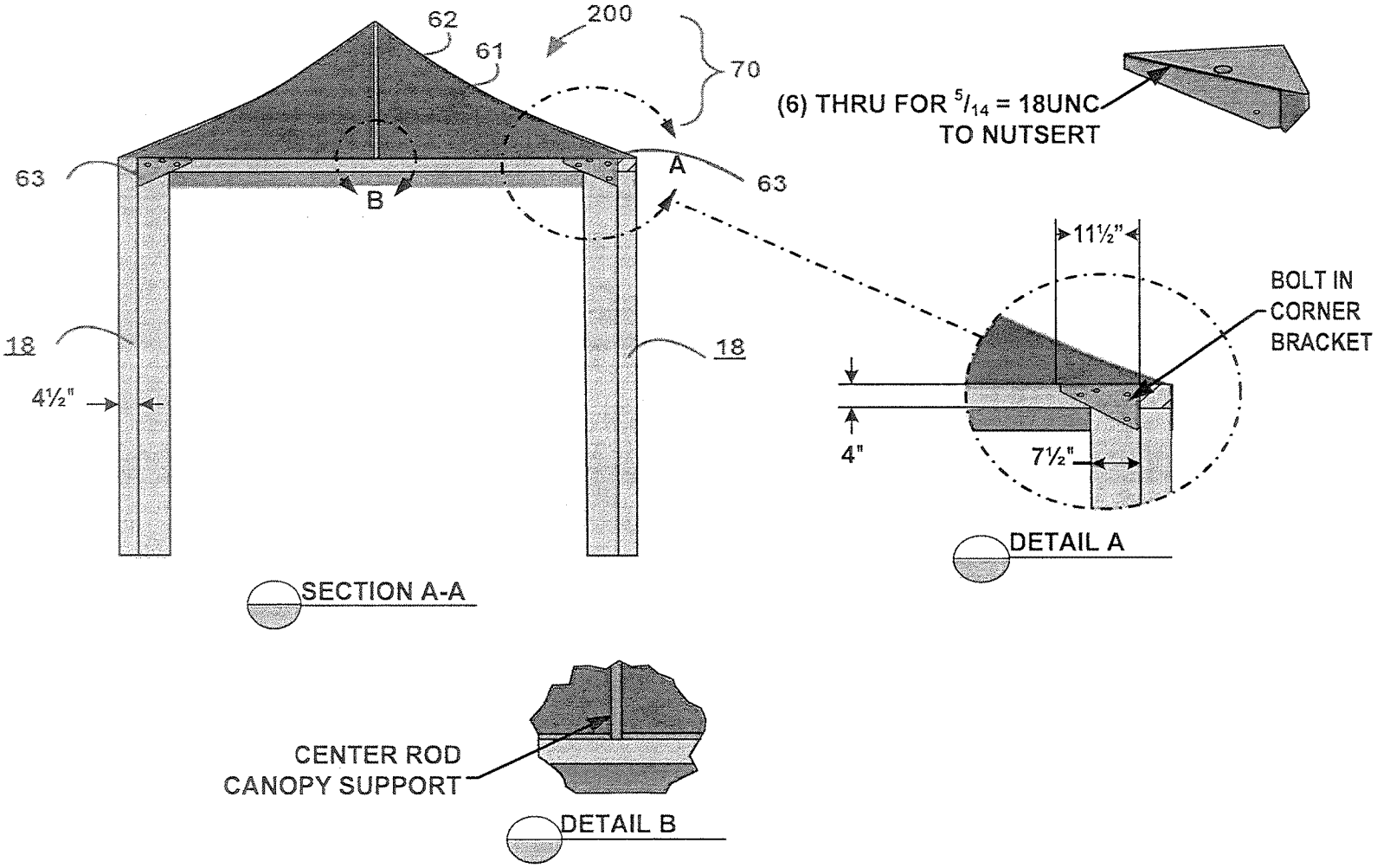
FIG. 7A is a side view of an exemplary event tent comprising structural panels, in accordance with various embodiments.
Figure 7B:
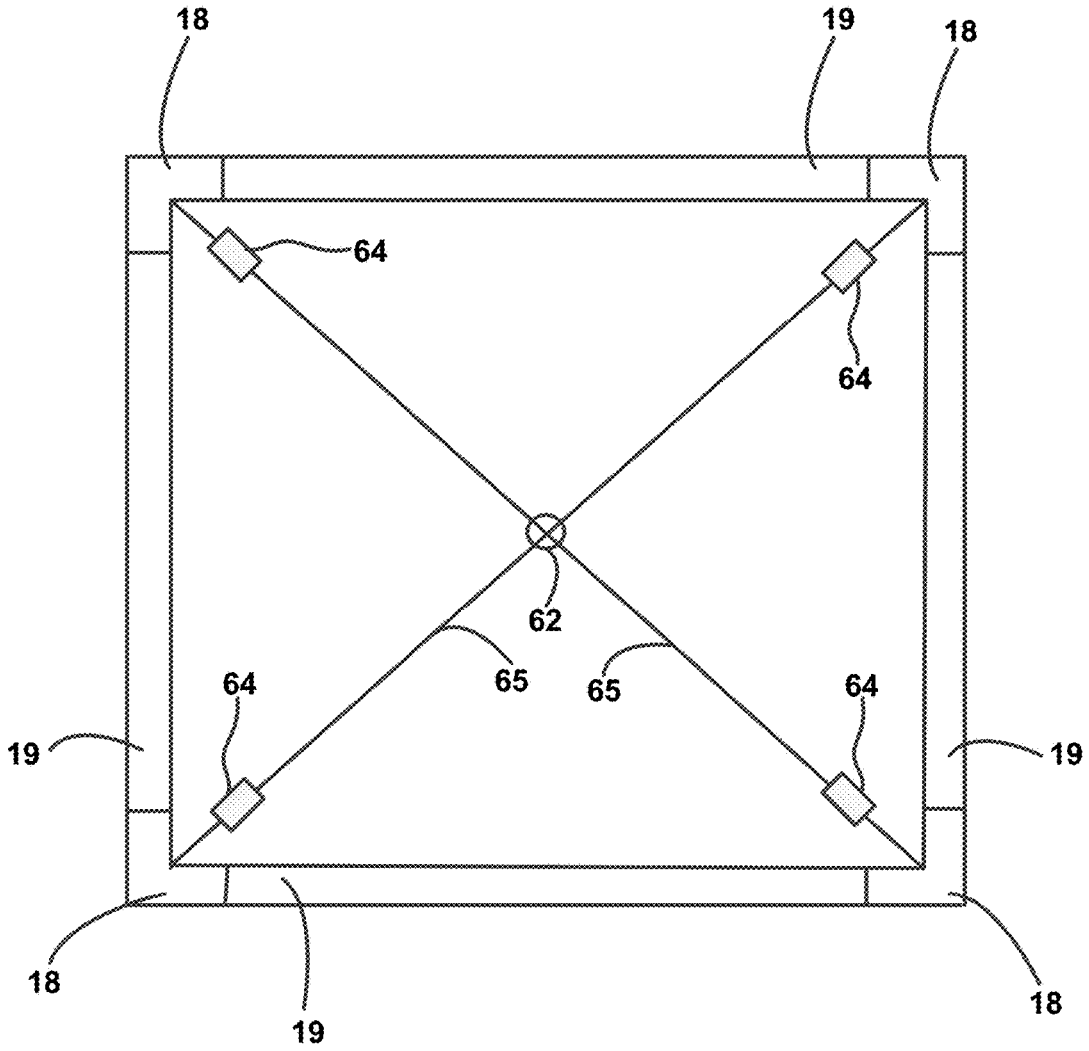
FIG. 7B is a top view of an exemplary event tent comprising structural panels, in accordance with various embodiments.

With particular reference to FIGS. 1, 7A-E, 8A-D, and 9A-E, the demountable structure system 2 may further comprise a roof system 70. A roof system 70 may be a panel style roof system (an exemplary roof system is shown in FIG. 9E), or may be a tent style roof system (an example of which is shown in FIG. 7A), or may be a rigid tent style roof system (an example of which is shown in FIG. 7E). A panel style roof system may comprise a roof made of structural panels 10. A tent style roof system and a rigid tent style roof system may comprise a roof made of a canvas 61 stretched over various other features discussed further herein. Moreover, a roof system 70 may comprise any arrangement of features and elements covering the top of the demountable structure system 2.

Figure 6A:
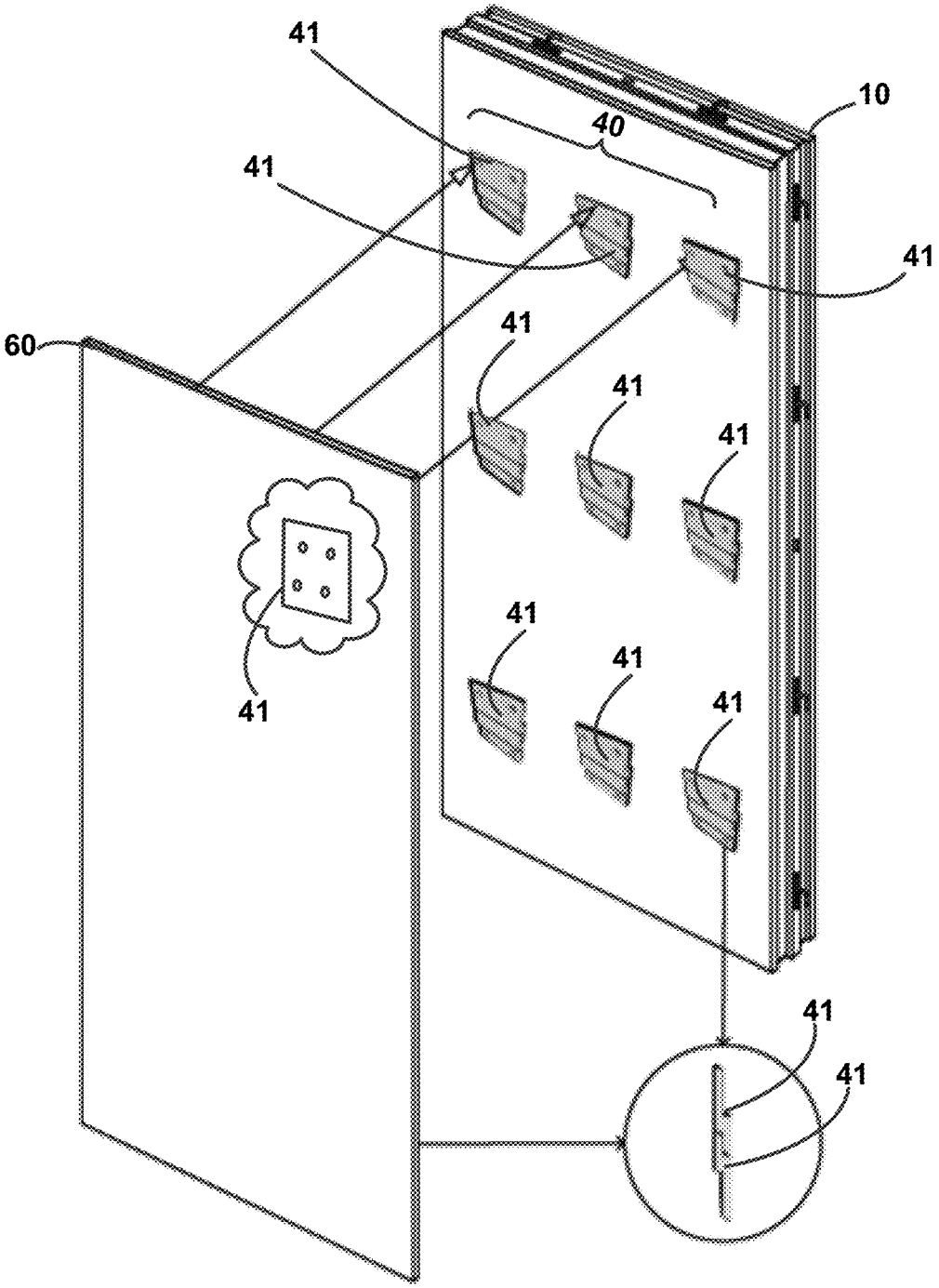
FIG. 6A is an exploded view of a finish panel and a structural panel showing the mounting of the finish panel to the structural panel, in accordance with various embodiments.
Figure 6B:
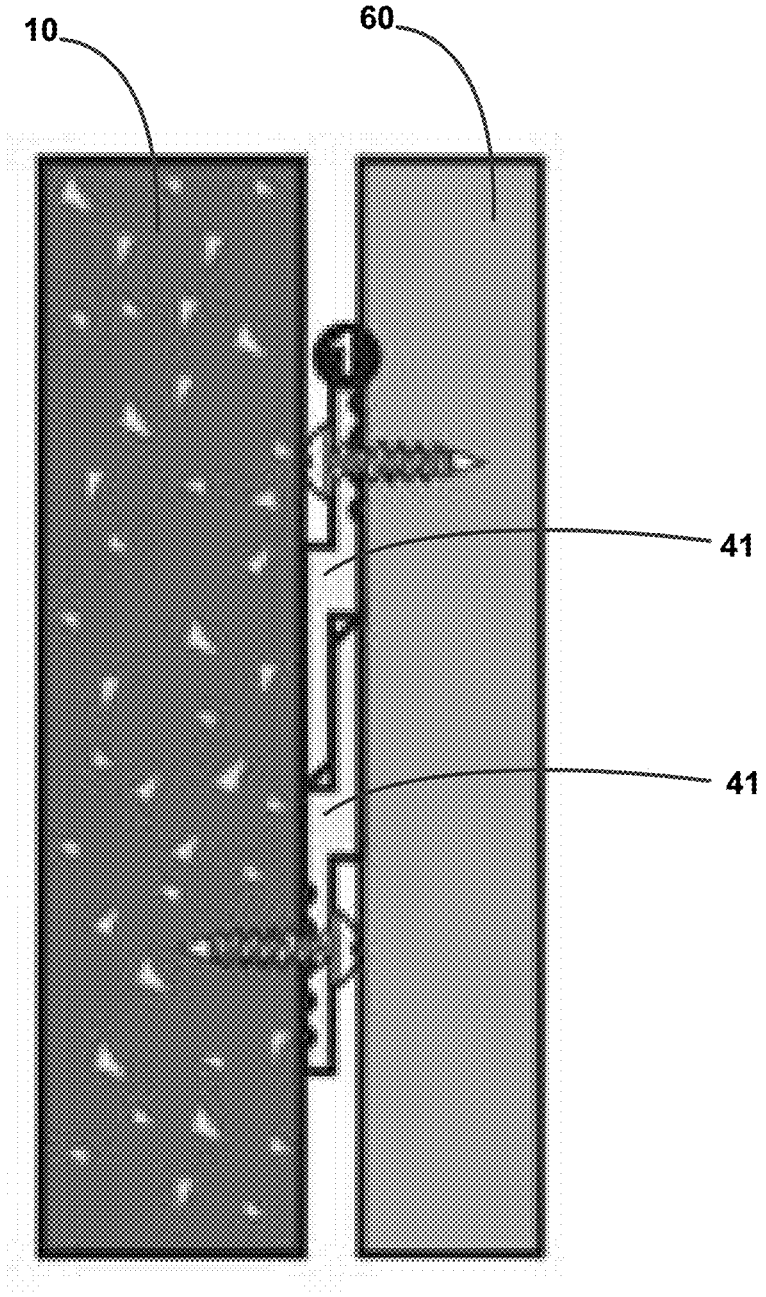
FIG. 6B is a section view of a finish panel mounted to a structural panel, in accordance with various embodiments.
Figure 6C:
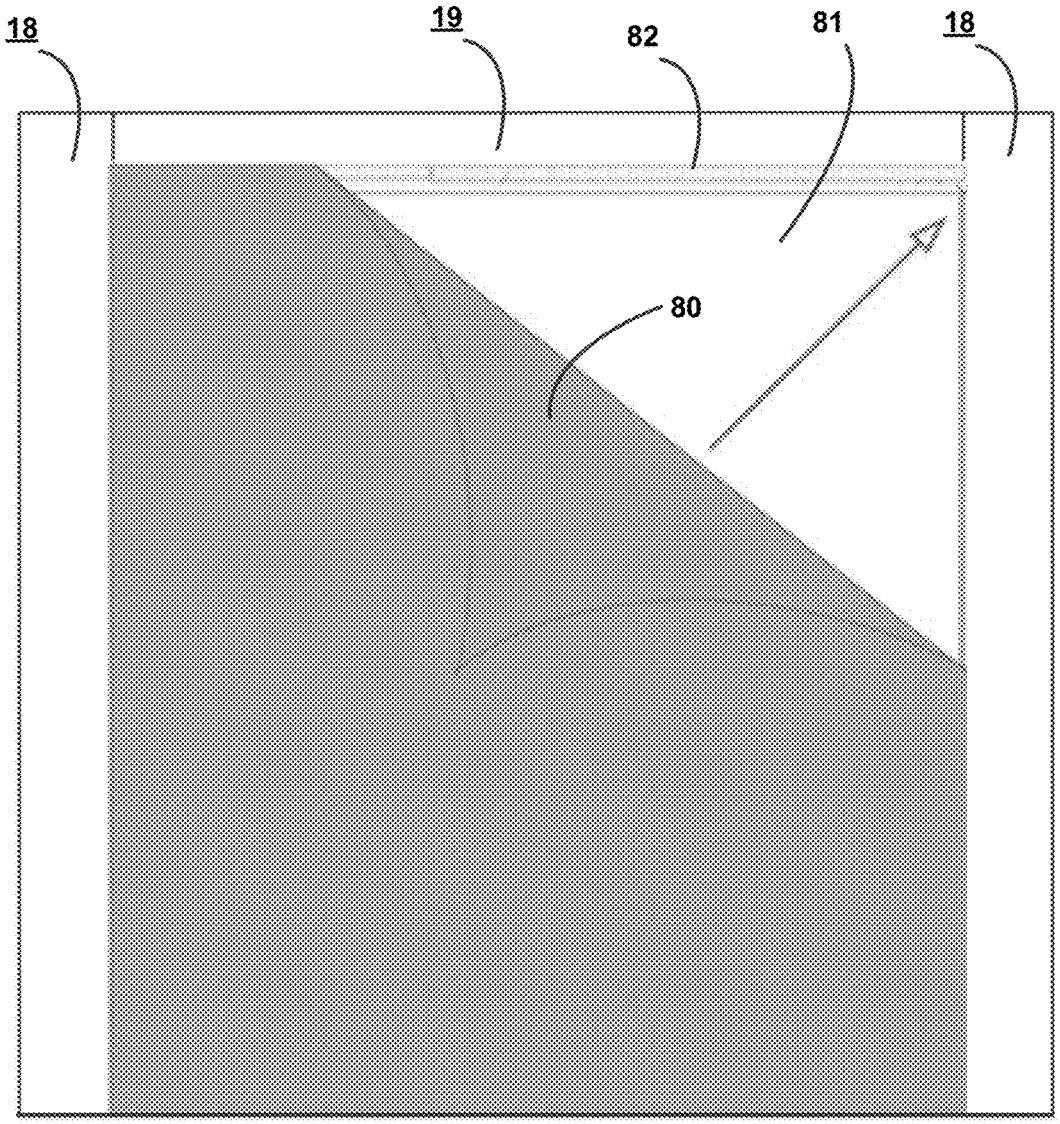
FIG. 6C is a view of a fabric panel mounted to a structural panel, in accordance with various embodiments.
Figure 6D:
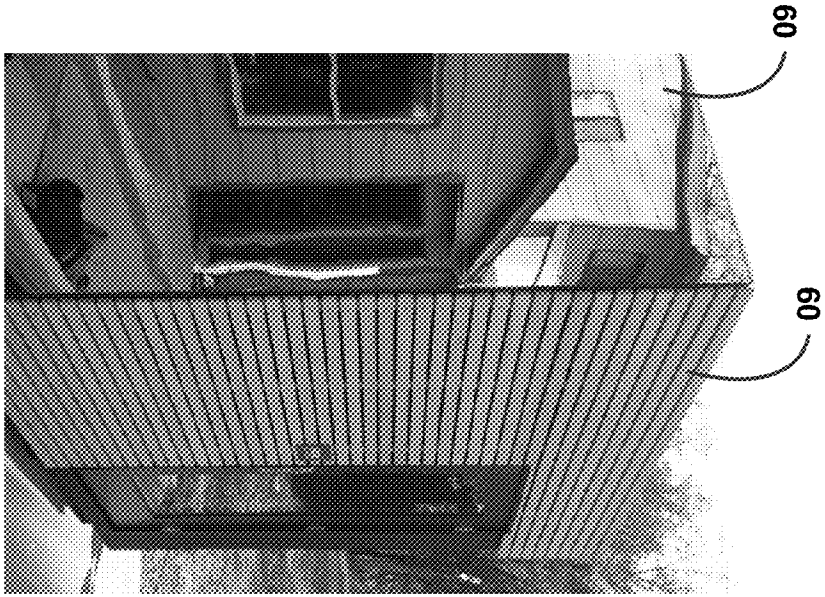
FIG. 6D is a view of various finish panels, in accordance with various embodiments.

Turning now to FIGS. 1 and 6C, the demountable event tent structure system 2 may also comprise one or more fabric panel(s) 80. For instance, one or more structural panel(s) 10 may define an aperture 81 desired to be selectably covered. A tube slide fastener 82 may retain the fabric panel 80 over the aperture 81, as desired. The fabric panel 80 may be cloth, or plastic, or natural or synthetic fibers, or any other similarly flexible material.

Figure 10B:
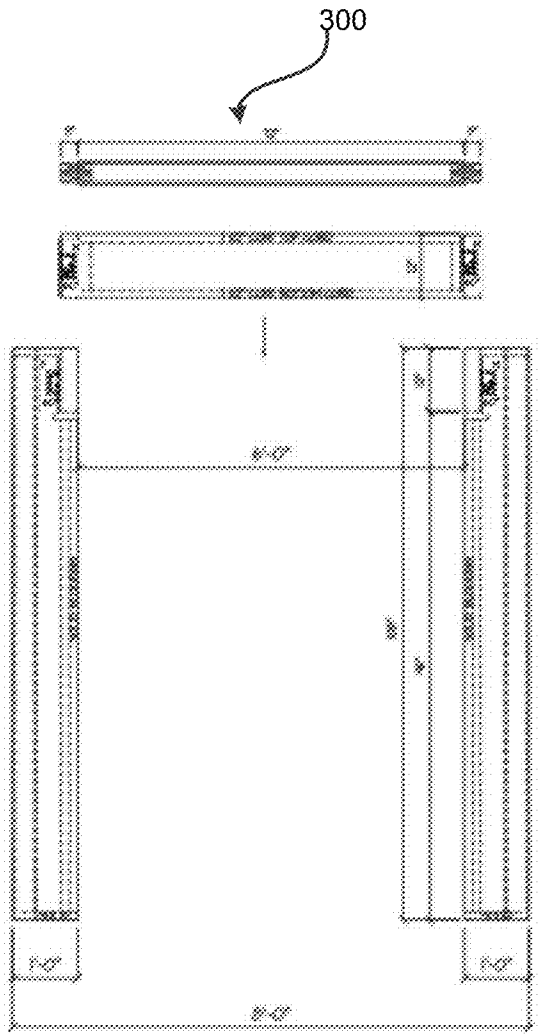
FIG. 10B is an exploded front view of an event tent comprising structural panels, in accordance with various embodiments.
Figure 10A:
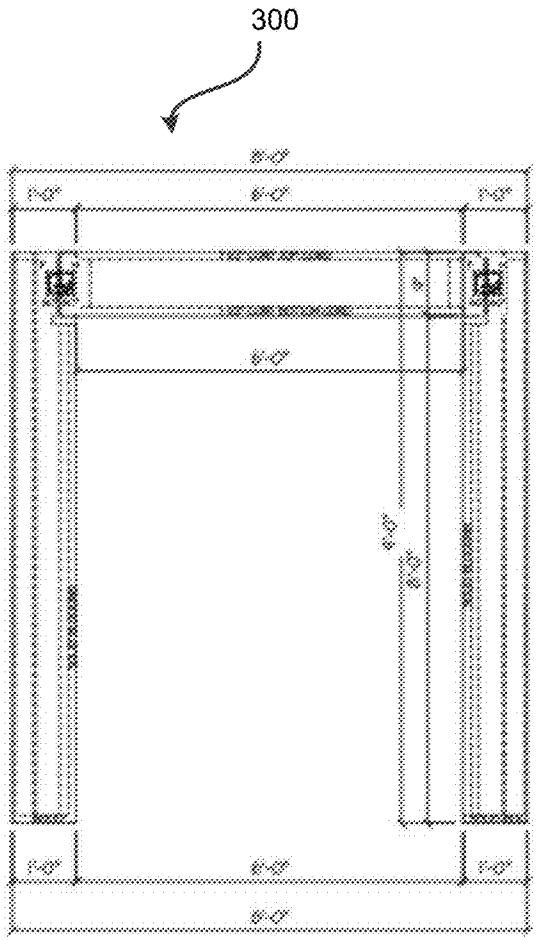
FIG. 10A is a front view of an event tent comprising structural panels, in accordance with various embodiments.
Figure 10C:
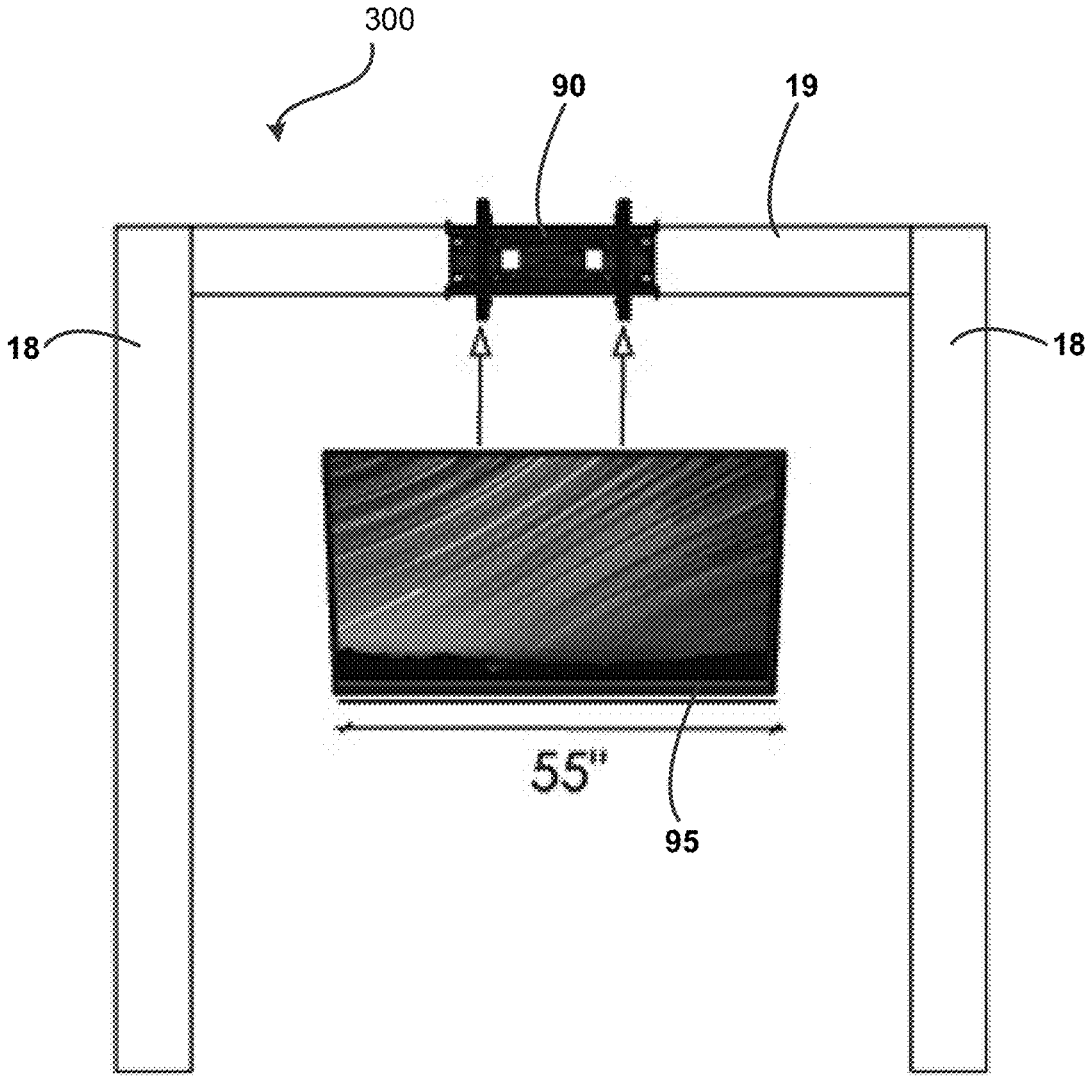
FIG. 10C is a view of various aspects of an exemplary event tent having an accessory mount, in accordance with various embodiments.
Figure 10D:
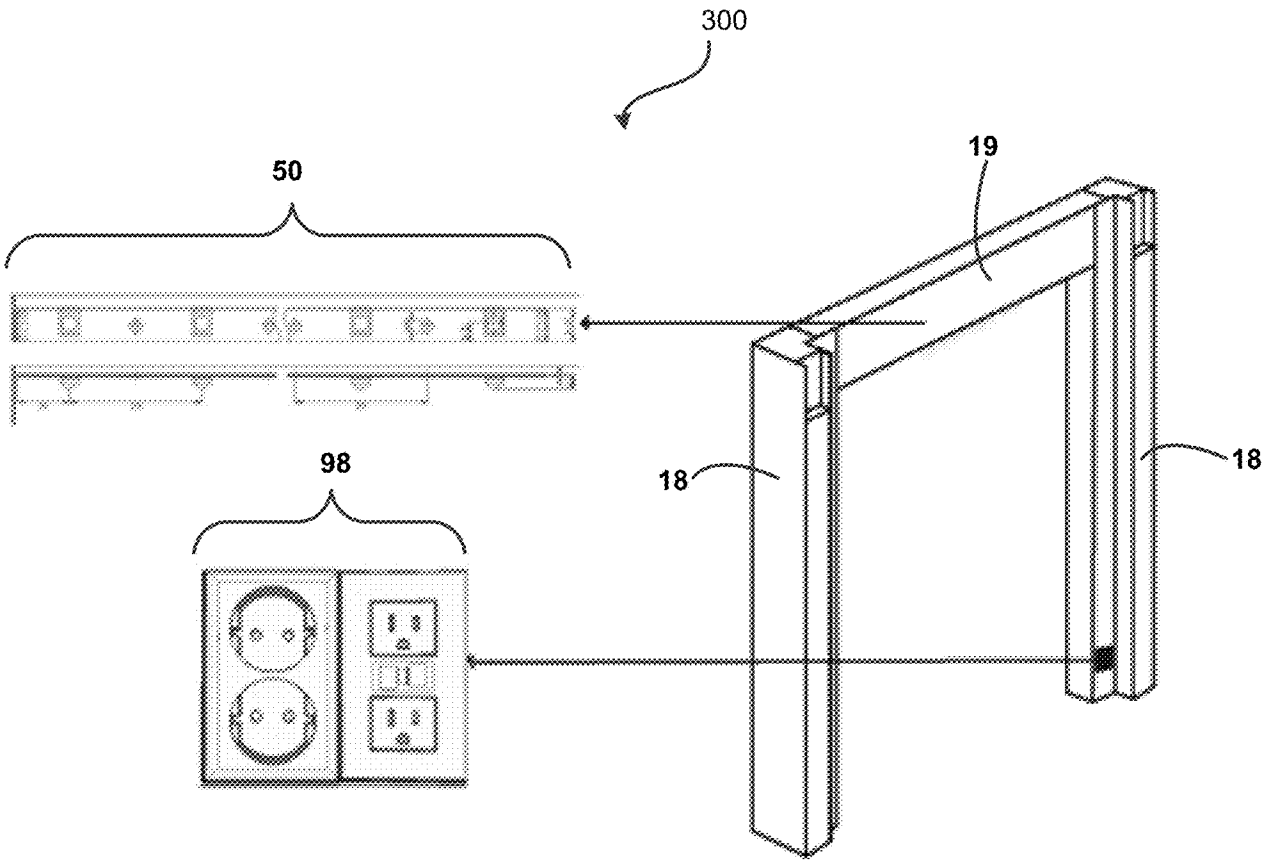
FIG. 10D is a view of various aspects of an exemplary event tent having recessed lighting and electrical outlets, in accordance with various embodiments.

With reference to FIGS. 1, 10C, and 10D the demountable structure system 2 may comprise an accessory mount 90. An accessory device 95 may be connected to the accessory mount 90, and subsequently may be removed, or may be replaced with a different accessory device 95. For instance, accessory devices 95 may be televisions, computer displays, signs, lighting, and the like. Fixtures, signage, electronic devices, and other apparatus may be supported by the demountable structure system 2. The accessory mount 90 enables the ready connection and disconnection of other apparatus to and from the demountable structure system 2. Thus, the demountable structure system 2 may be readily repurposed.

As illustrated in the exemplary embodiments shown in FIGS. 1 and 10D, the demountable structure system 2 may also comprise recessed lighting 97. For example, recessed lighting 97 may be disposed in the structural panel 10, for example, a tent transverse header panel 19 (FIG. 10D), although recessed lighting 97 may be disposed in any structural panel 10.

Similarly, the demountable structure system 2 may also comprise electrical outlets 98. For example, electrical outlets 98 may be disposed in the structural panel 10, for example, a corner pillar panel 18, although electrical outlets 98 may be disposed in any structural panel 10.

Figure 10E:
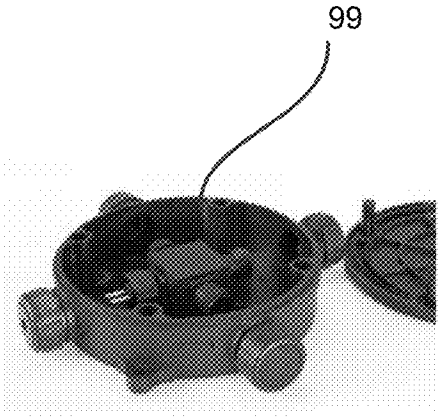
FIG. 10E is a view of an electrical connector comprising a power distribution connector, in accordance with various embodiments.
Figure 10F:
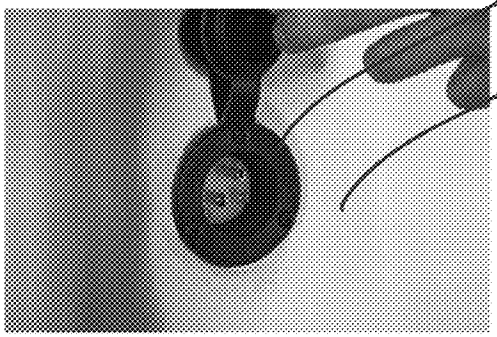
FIG. 10F is a view of an electrical connector installed in a an event tent corner pillar panel, in accordance with various embodiments.

Electrical connectivity, such as for recessed lighting 97, electrical outlets 98 and any other desired electrical connectivity (for example, as may be provided in association with an accessory mount 90) may be provided by connectors. For instance, with reference to FIGS. 1, and 10A-G, in various embodiments, the electrical outlets 98, and/or recessed lighting 97, and/or other desired electrical connectivity receive electrical power from input connectors 99 and/or interpanel connector systems 94 associated with the structural panel 10. In various embodiments, the input connector 99 is installed in a structural panel 10 and receives a standard electrical extension cord (FIG. 10F), whereas in further embodiments, the input connector 99 is a power distribution connector that provides a distribution interface to direct electrical power to various loads or other structural panels 10 (FIG. 10E). The input connector 99 may comprise an interconnection connector among different structural panels (e.g., an interpanel connector of an interpanel connector system 94) (FIG. 10G).

Figure 10G:
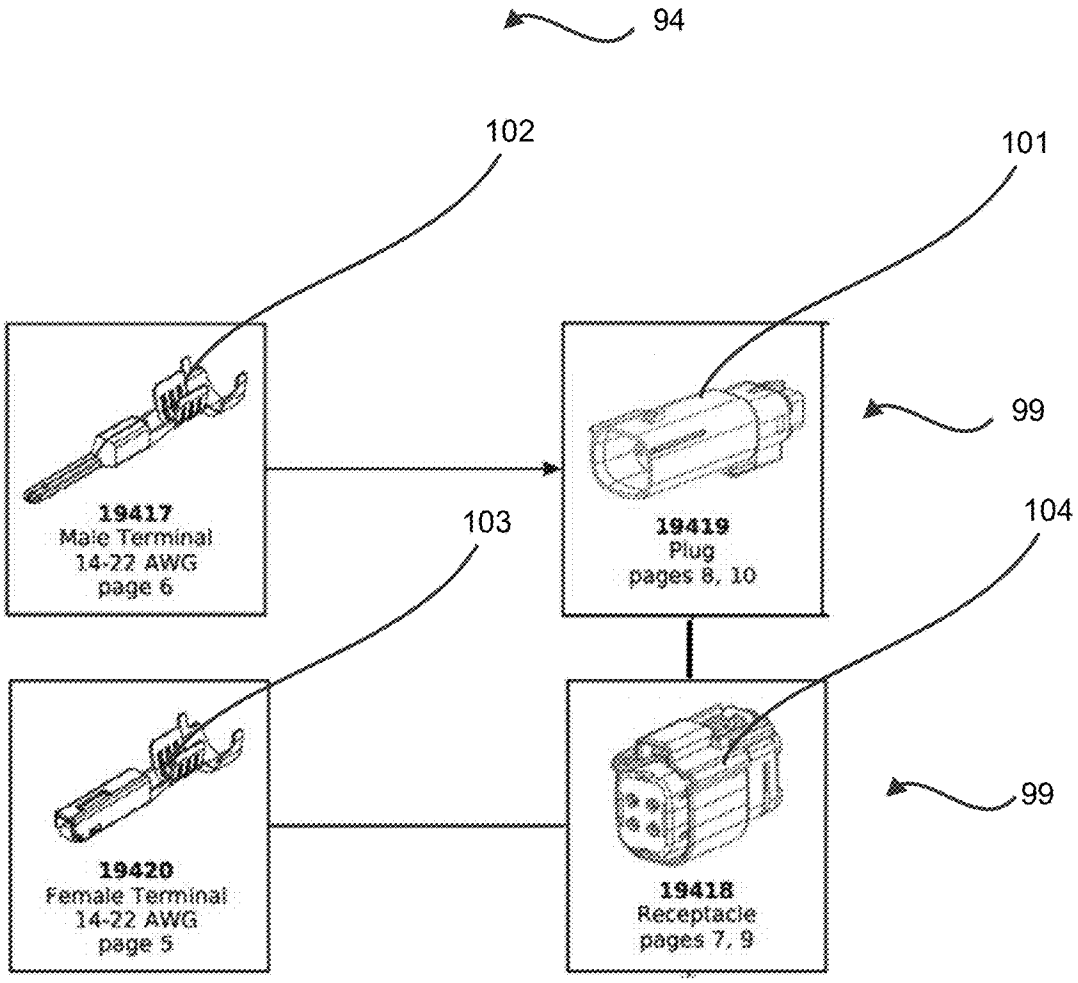
FIG. 10G is a view of an structural interpanel connector system, in accordance with various embodiments.

With reference to FIG. 10G, various input connectors 99 may be implemented. For instance, structural panels 10 may be interconnected by a MX150L™ Industrial Sealed Connector System available from Molex Incorporated of Lisle, Ill. (interpanel connector system 94). As depicted in FIG. 10G, an interpanel connector system 94 may comprise an input connector 99 comprising a plug 101 with at least one male terminal 102. The plug 101 may be associated with a first structural panel. Another input connector 99 comprising a receptacle 104 with at least one female terminal 103 may be associated with a second structural panel. When the structural panels are joined together, the input connectors 99 of the interpanel connector system 94 may be in electrical continuity, so that one or more electrical circuit is continued between the panels. An at least 10-circuit plug 101 and receptacle 104 may be implemented and may be configured for 12-AWG terminals. Electrical connectivity between structural panels can be internally either vertical or horizontal. However, other connectors and terminals may be implemented as desired.

Having discussed various aspects of a demountable structure system 2, specific attention is directed to the structural panel 10 and its various features and elements in certain exemplary embodiments. With emphasis on FIGS. 2 and 3A, a structural panel 10 may have a panel shape (discussed further herein) and may comprise one or more joining member(s) 20, joining edge(s) 30, finish panel attachment point(s) 40, and may have an internal structure 50.

In various embodiments, the structural panel 10 may have differing lengths, heights, and thicknesses. For example, the height may be four feet, or eight feet, or nine feet. In further embodiments, the height may twenty-four feet, or may be any desired height, such as six feet, ten feet, twelve feet, fourteen feet, sixteen feet, eighteen feet, twenty feet, or twenty-two feet, or any desired height. Moreover, the length may be four feet in some embodiments. In further embodiments, the length may be any even number of feet, although length may still further be any desired size. For example, a structural panel 10 may comprise a four feet by eight feet panel, although alternative sizes may be contemplated. Structural panel 10 may also have varying thicknesses. The thickness may be three and five-eighths inches, although any desired thickness may be contemplated.

Returning attention to FIG. 2, a structural panel 10 may comprise a joining member 20. Several joining members 20 may be arranged around the sides of the structural panel 10. Joining member 20 may comprise a cam-lock, or may comprise a cam-lock receptacle, or may comprise any apparatus by which a structural panel 10 may be joined to another structural panel 10. Joining members 20 may be arranged around the edges of the structural panel 10, such as along the joining edges 30 (discussed further herein). The joining members 20 of the structural panel 10 are selectably engagable with the joining members 20 of another structural panel 10. In this manner, structural panels 10 may be selectably joined and separated, as desired. In various embodiments, two joining members 20 are disposed along the joining edge 30 of the structural panel 10—one near each opposite end of the joining edge 30. In further embodiments, one or more additional joining member(s) 20 is disposed along the joining edge 30 of the structural panel 10, such as evenly spaced along the length of the joining edge 30, or centered on the joining edge 30, or disposed proximate to areas of concentrated load, such as near a concentration of weight supported by the structural panel(s) 10.

Figure 2:
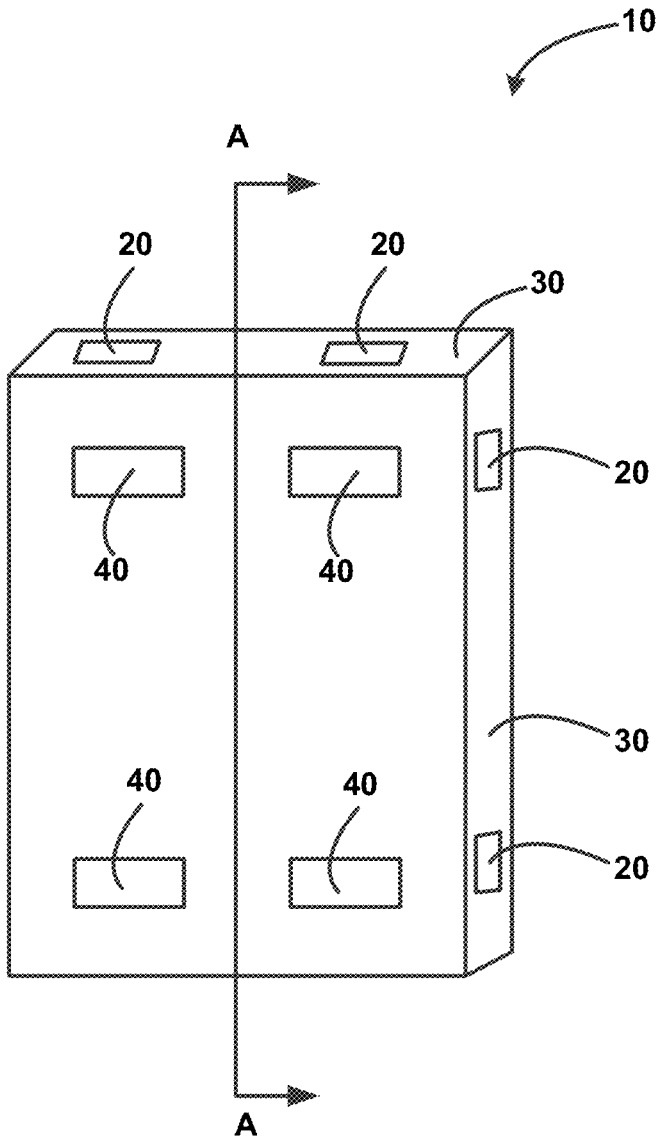
FIG. 2 is a block diagram of various aspects of an exemplary structural panel in accordance with various embodiments.
Figures 4A, 4B, 4C, 4D:
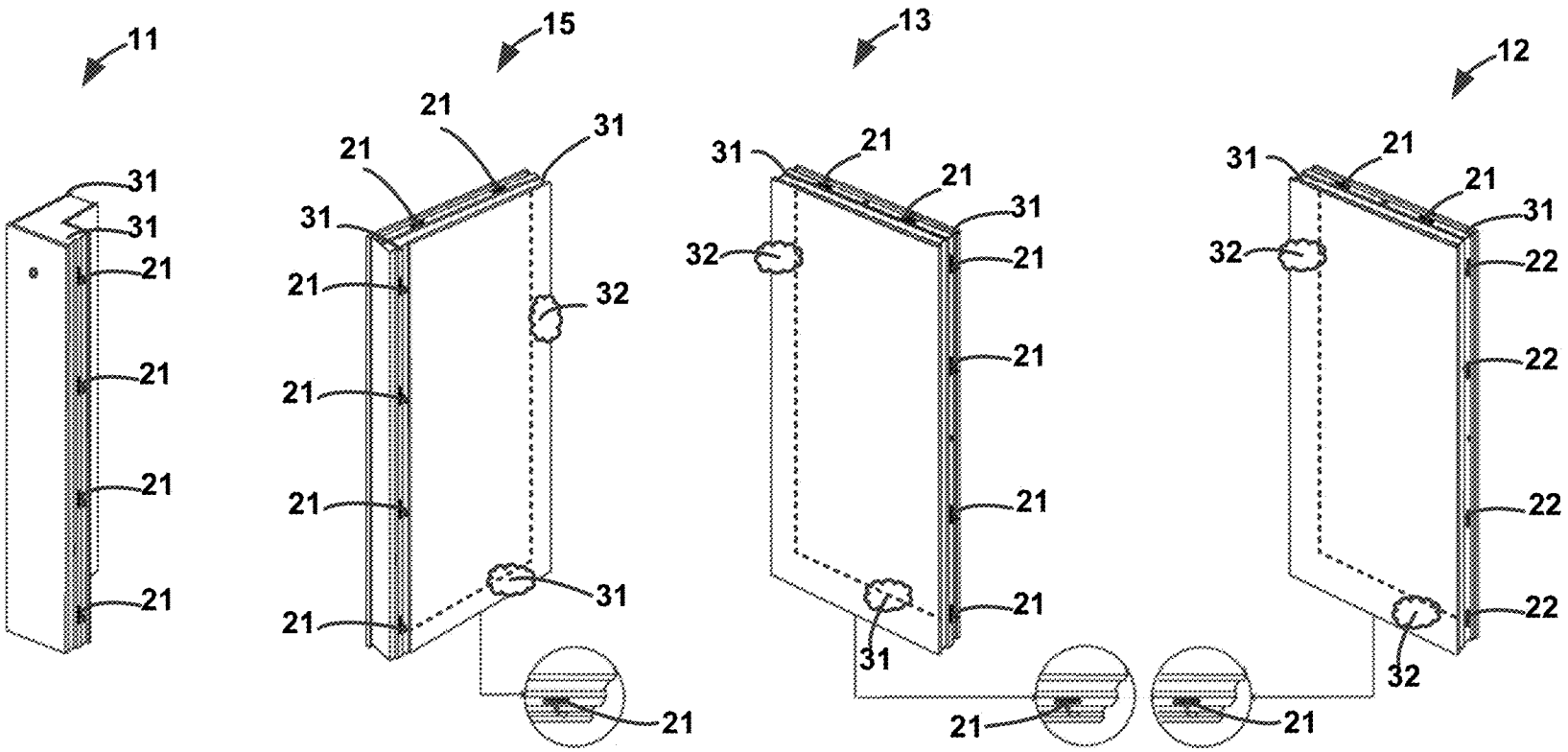
FIG. 4A is a view of an exemplary structural panel comprising a corner panel, in accordance with various embodiments.
FIG. 4B is a view of an exemplary structural panel comprising an edge panel, in accordance with various embodiments.
FIG. 4C is a view of an exemplary structural panel comprising a three-side male, one-side female wall panel, in accordance with various embodiments.
FIG. 4D is a view of an exemplary structural panel comprising a two-side male, two-side female wall panel, in accordance with various embodiments.
Figure 4F:
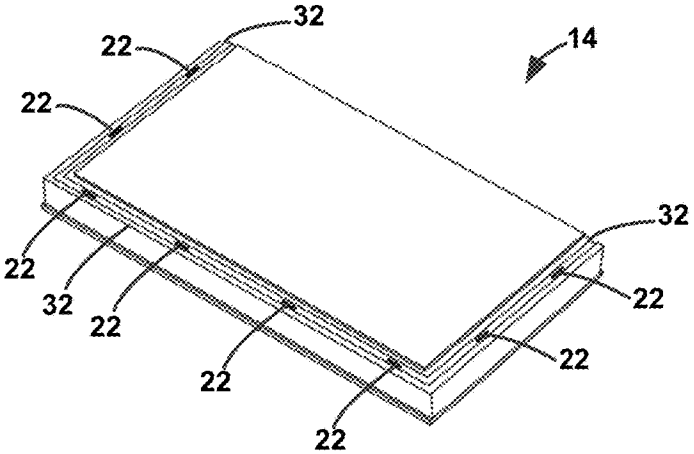
FIG. 4F is a view of an exemplary structural panel comprising a floor/ceiling panel, in accordance with various embodiments.
Figure 4E:
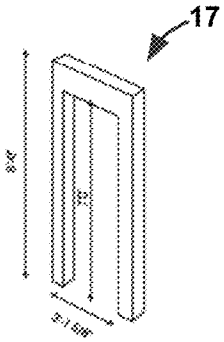
FIG. 4E is a view of an exemplary structural panel comprising a door panel, in accordance with various embodiments.
Figure 4H:
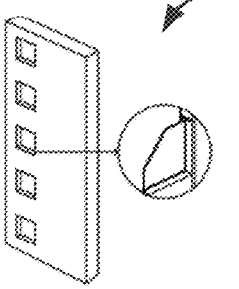
FIG. 4H is a view of an exemplary structural panel comprising a window block panel, in accordance with various embodiments.
Figure 4G:
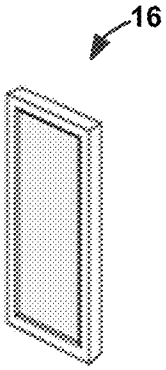
FIG. 4G is a view of an exemplary structural panel comprising a window panel, in accordance with various embodiments.
Figure 4I:
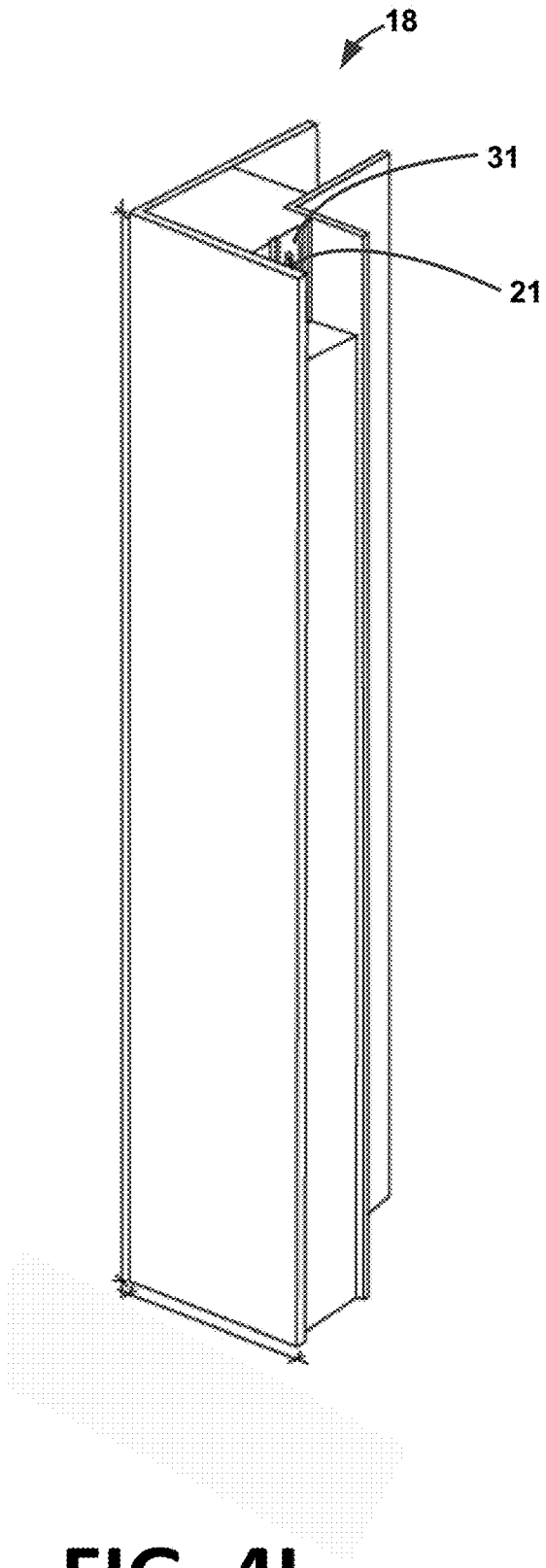
FIG. 4I is a view of an exemplary event tent structural panel comprising a corner pillar panel, in accordance with various embodiments.
Figure 4J:
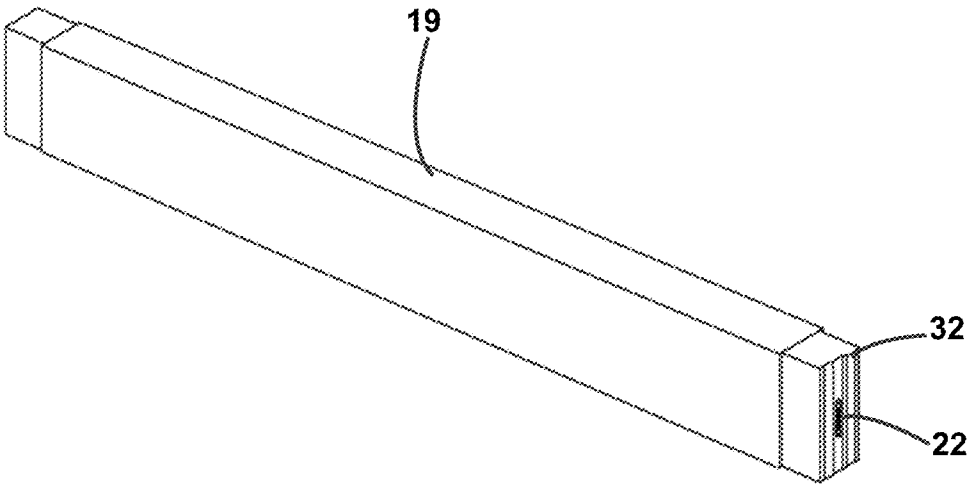
FIG. 4J is a view of an exemplary event tent structural panel comprising a transverse header panel, in accordance with various embodiments.

Continuing with reference to FIG. 2 and with additional reference to FIGS. 1, 4C, and 4F, the structural panel 10 may comprise a joining edge 30. The joining edge 30 comprises one or more face(s) of a structural panel 10 oriented to abut a corresponding face of one or more additional structural panel(s) 10, so that the structural panels 10 may be connected together. For example, the joining edge 30 may further comprise grooves and bosses, as will be discussed further below, to facilitate the connection of structural panels 10 together. The joining edge 30 may be positioned around a perimeter of the structural panel 10, such as illustrated in FIG. 4C (see boss edge 31), or may be positioned near the edge of a face of the structural panel 10, such as illustrated in FIG. 4F, (see boss receiving edge 32). The structural panel 10 may comprise a number of joining edges 30, and the joining edges 30 may be positioned differently, depending on the desired arrangement of structural panels 10 in the demountable structure system 2 (FIG. 1).

Figure 3A:
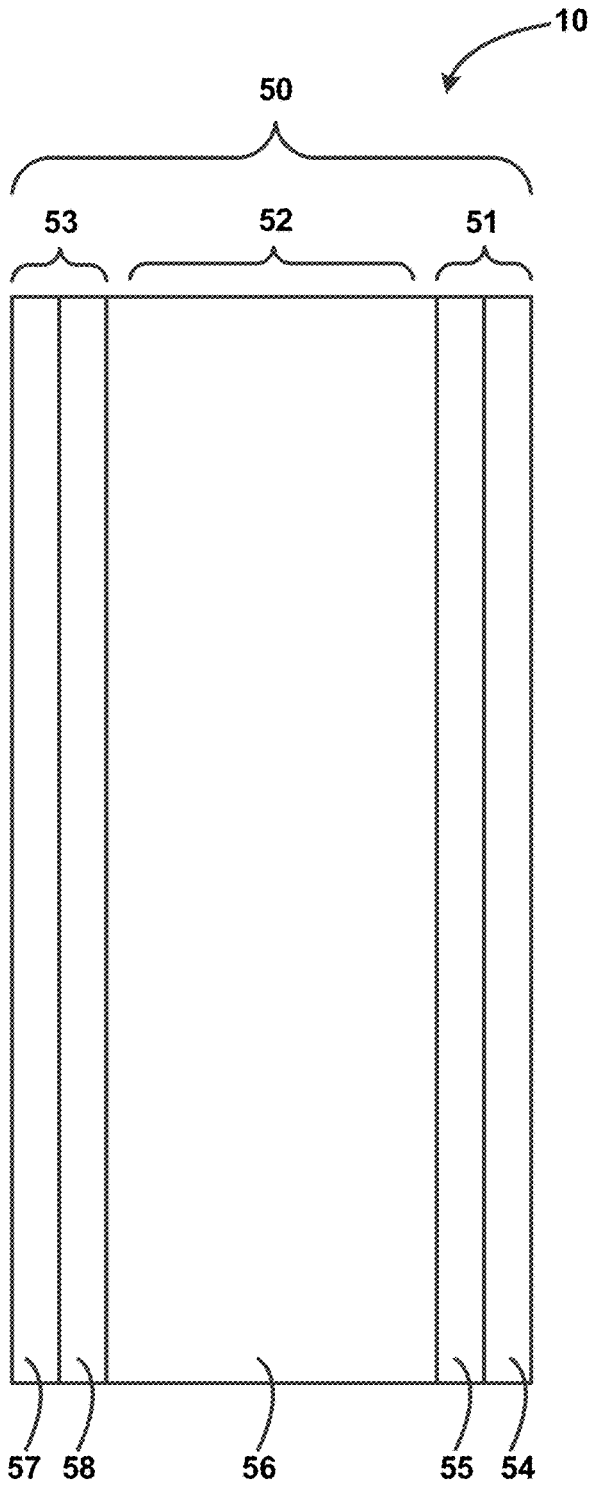
FIG. 3A is a sectional view taken along line A-A of the exemplary structural panel of FIG. 2 illustrating various internal features of the exemplary structural panel, in accordance with various embodiments.
Figure 3B:
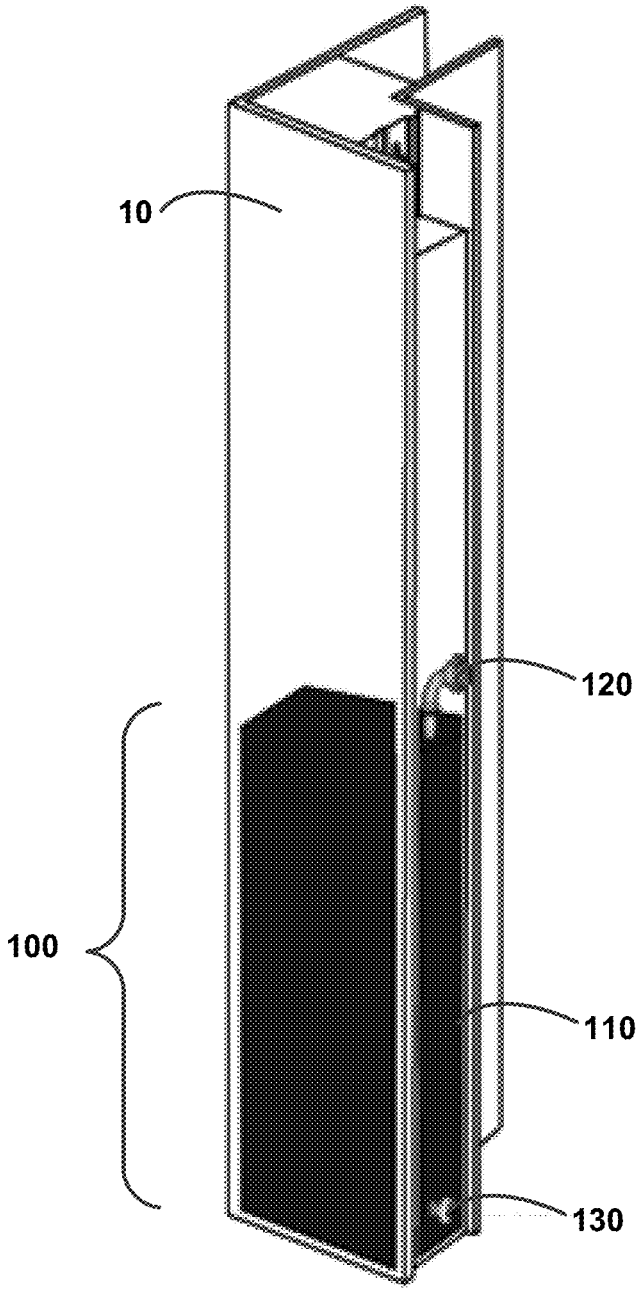
FIG. 3B is a view of an exemplary structural pillar panel illustrating various internal features of the exemplary event tent comprising ballast system including an internal water bladder, in accordance with various embodiments.

With reference to FIGS. 3A-B, the structural panel 10 may further comprise an internal structure 50. The internal structure 50 may be an arrangement of panels, voids, and equipment inside the structural panel 10. For instance, the internal structure 50 may comprise an inner panel 51, an internal pocket 52, and an outer panel 53. Stated differently, the structural panel 10 may comprise an internal structure 50, the internal structure 50 defined by an inner panel 51 parallel to an outer panel 53, and spaced away from the outer panel 53 to form an internal pocket 52. As such, the structural panel 10 may be hollow. In further embodiments, the internal structure 50 may comprise a ballast system 100 whereby the structural panel 10 is weighed down to reduce undesired movement.

Figure 6E:
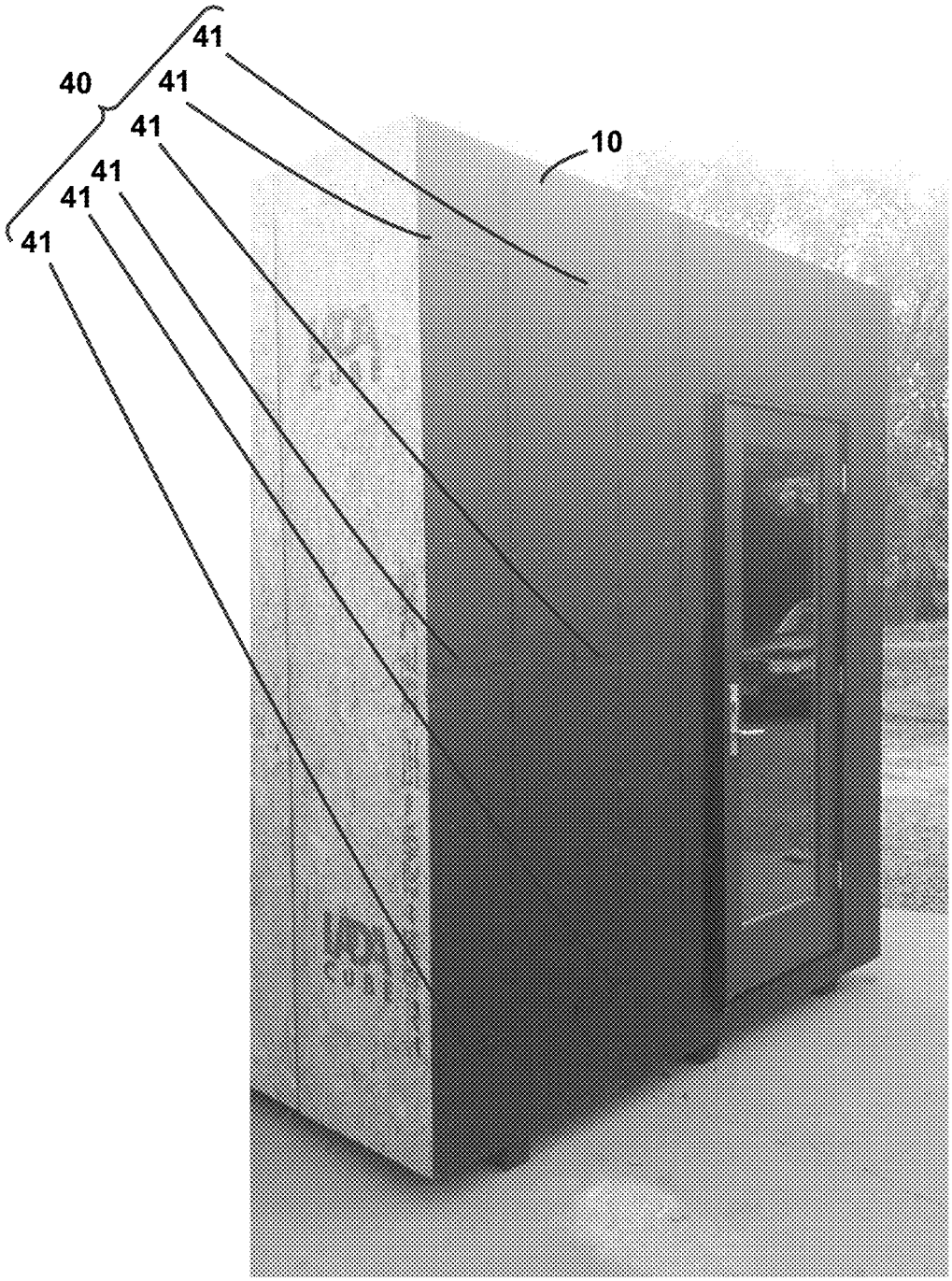
FIG. 6E is an view of a structural panel showing an example arrangement of finish panel attachment points, in accordance with various embodiments.
Figure 6F:
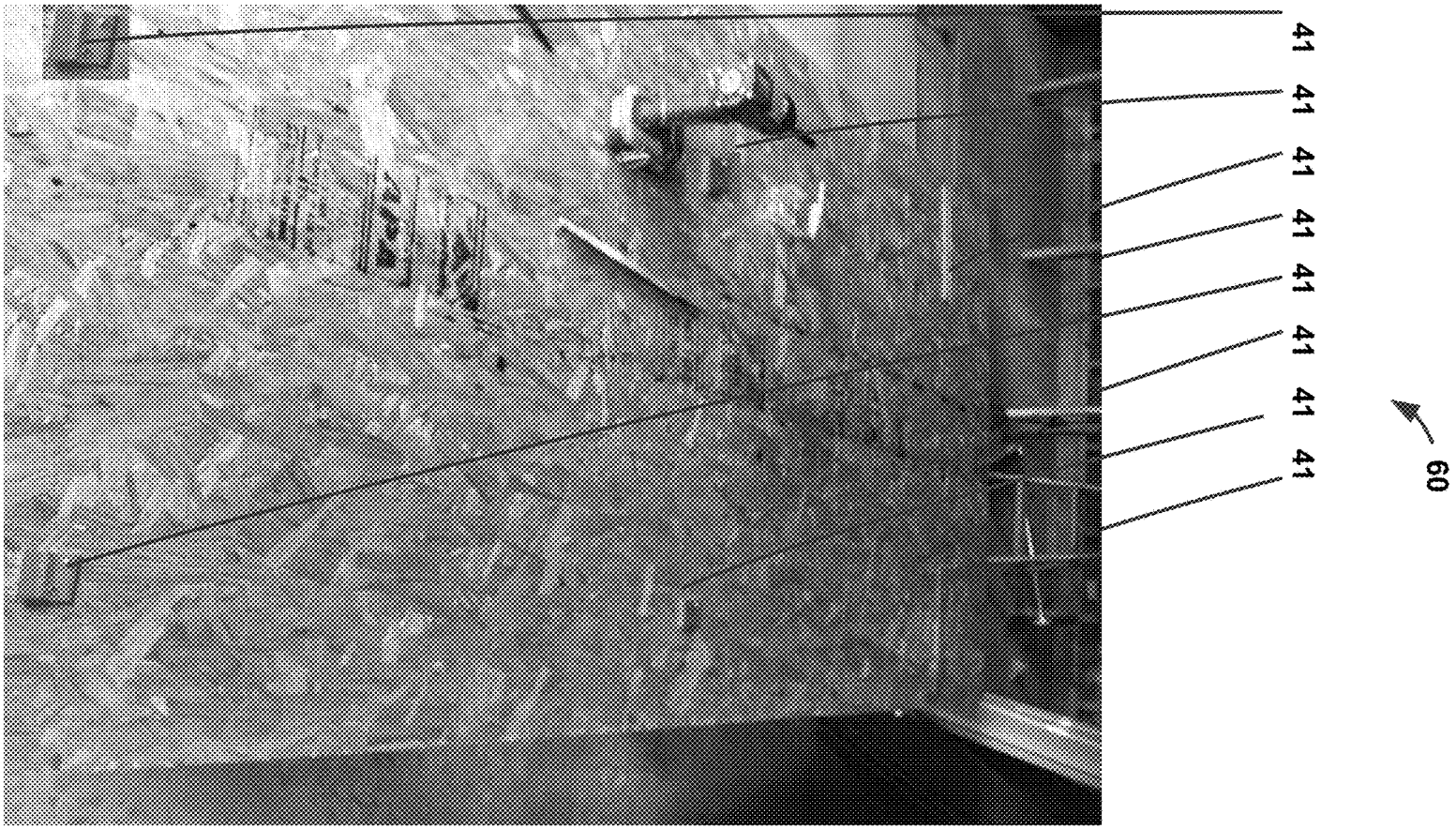
FIG. 6F is a view of a finish panel under construction showing an example arraignment of mounting brackets, in accordance with various embodiments.

Turning now to FIG. 2 and FIGS. 6A-B, and FIGS. 6E-F, the structural panel 10 may also comprise finish panel attachment points 40. Finish panel attachment points 40 may comprise a bracket, clip, or other apparatus whereby the finish panel 60 may be joined to the structural panel 10. Finish panel attachment points 40 may be spaced across one or more face(s), such as an interior face, of the structural panel 10. Finish panel attachment points 40 may be spaced across an exterior face of the structural panel 10 as desired. Any number, orientation, or spacing of finish panel attachment points 40 may be contemplated to enable a desired arrangement of finish panels 60. In various embodiments, structural panel 10 has nine finish panel attachment points 40 for each finish panel 60 desired to be attached. With further reference to FIGS. 6E and 6F, structural panel 10 may have six finish panel attachment points 40 for each finish panel 60 desired to be attached.

Furthermore, finish panel attachment points 40 may comprise mounting brackets 41. Mounting brackets 41 may comprise a substantially "Z" shaped piece of material (e.g., a "Z-clip"), such as a metal extrusion. In further embodiments, finish panel attachment points 40 may comprise a bracket, clip, or other apparatus whereby a finish panel 60, or another desired fixture, panel, or apparatus may be joined to the structural panel 10. Furthermore, different finish panel attachment points 40 may comprise different attachment mechanisms, for example, some may be mounting brackets 41 comprising Z-clips, while others may comprise a bracket, clip, or other apparatus. In various embodiments, with reference to FIGS. 6E and 6F, a finish panel attachment points 40 may comprise mounting brackets 41 comprising about ten inch (about 25.4 cm) long mounting brackets.

The finish panel 60 may also comprise mounting brackets 41. As with the structural panel 10, the finish panel 60 may have mounting brackets 41 that comprise a substantially "Z" shaped piece of material (e.g., a "Z-clip"), such as a metal extrusion. Mounting brackets 41 may comprise a bracket, clip, or other apparatus whereby the finish panel 60 may be joined to the structural panel 10. Mounting brackets 41 are arranged to interface with the finish panel attachment point 40 of the structural panel 10. As such, the finish panel attachment point 40 of the structural panel 10 may comprise a corresponding mounting bracket 41, oriented to interlock with the mounting bracket 41 attached to the finish panel 60. Notably, the finish panel 60 may comprise mounting brackets 41 of different size than the mounting brackets 41 of the finish panel attachment points 40. For instance, a finish panel 60 may have two about ten inch (about 25.4 cm) long mounting brackets 41 disposed toward the top edge of the finish panel 60 and four about 1½ inch (about 3.8 cm) long mounting brackets disposed below these. Thus, a finish panel may comprise mounting brackets 41 comprising mounting brackets 41 of different sizes than those mounting brackets 41 of the finish panel 60. In this manner, the finish panels 60 may be more readily aligned and adjusted in position relative to each other and to the structural panel(s) 10.

Mounting brackets 41 may be spaced across one or more face(s) of the finish panel 60. Any number, orientation, or spacing of mounting brackets 41 may be contemplated as desired to enable the desired arrangement of finish panels 60, in view of the corresponding arrangement of finish panel attachment points 40 of the structural panels 10. In various embodiments, finish panel 60 comprises nine mounting brackets 41. Notably in other embodiments, there is not a one-to-one correspondence between the mounting brackets 41 of the finish panel 60, and the finish panel attachment points 40 of the structural panel 10. As such, one finish panel 60 may span more than one structural panel 10 and may be attached to more than one structural panel 10.

Now, with attention to FIGS. 1, 7A-E, 8A-D, and 9A-E, the event tent comprising of structural panel system 2 may comprise the roof system 70. The roof system 70 may be a tent style roof system or a rigid tent style roof system such as illustrated in FIGS. 8A-D. For instance, the roof may comprise a variety of shapes. A tent style roof system or a rigid tent style roof system may be a pyramid roof (FIG. 8A), a dome roof (FIG. 8B), a staggered triangle roof (FIG. 8C), or a louvered panel roof (FIG. 8D), among others. With reference to FIG. 8A, a pyramid roof may comprise a single vertical peak and tapering triangular faces extending to each corner of the demountable structure system 2. With reference to FIG. 8B, a dome roof may comprise a semispherical canopy. A sectional plane of the dome roof may comprise a substantially circular profile near the peak of the roof, and may progressively transform into a substantially more rectangular profile approaching the base of the roof and extending to each corner of the demountable structure system 2. With reference to FIG. 8C, a staggered triangle roof may comprise multiple peaks or asymmetrical peaks extending in a first direction and spaced in a perpendicular direction along the profile of the demountable structure system 2 and may extend beyond structure to create an extension of canopy beyond base of unit 18 & 19. Finally, with reference to FIG. 8D, a louvered panel roof may comprise a series of substantially planar panels extending upwardly away from the demountable structure system 2 and spaced along the profile of the demountable structure system 2. In some embodiments, the louvered panel roof may be adjustable, so that the angle of the panels may be adjusted up and down so that the louvered panel roof may be substantially more open, or substantially more closed, as desired.

Having discussed various aspects of a demountable structure system 2, attention is now directed to FIGS. 1, 2 and FIG. 4C-D, and to various aspects of the joining member 20. The joining member 20 may comprise a cam 21 (see FIG. 4C), and/or a cam receiver 22 (see FIG. 4D). For example, a cam 21 may comprise a fastening mechanism having a curved or hook shaped member extending outwardly from the joining edge 30 of the structural panel 10. The cam 21 may be rotatable about an axis, so that the curved or hook shaped member may engage with a cam receiver 22 such as associated with the joining member 20 of an adjacent structural panel 10. The cam 21 may further translate substantially normal to the face of the joining edge 30 to draw the cam receiver 22 nearer to the joining edge 30 of the structural panel 10. In further examples, the cam receiver 22 may comprise an aperture disposed in the joining edge 30 of the structural panel 10, and corresponding in location to the cam 21 such as associated with the joining member 20 of an adjacent structural panel 10. In this manner, two structural panels 10 may be selectably joined together, and loaded in compression along their joining edges 30.

Figure 5A:
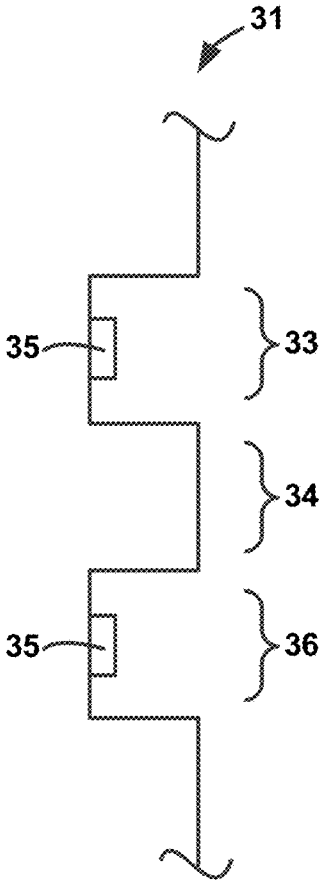
FIG. 5A is a view of a joining edge of a structural panel comprising a boss edge, in accordance with various embodiments.
Figure 5B:
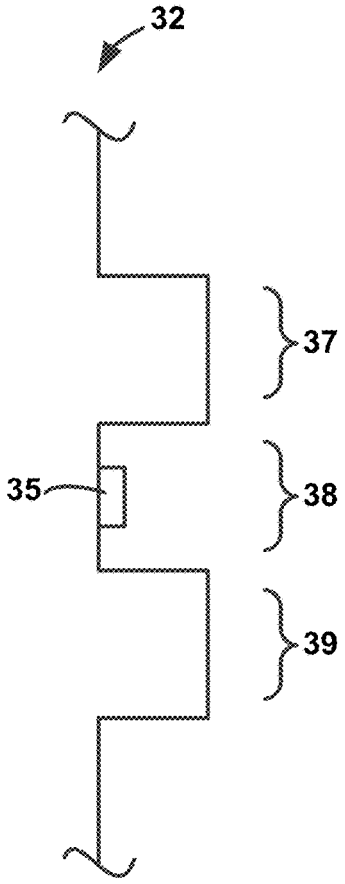
FIG. 5B is a view of a joining edge of a structural panel comprising a boss receiving edge, in accordance with various embodiments.

Continuing in reference to FIGS. 1, 2, 4C-D and with additional reference to FIGS. 5A-B, the joining edge 30 may comprise a boss edge 31 or a boss receiving edge 32. A boss edge 31 may comprise two grooves 33 and 36, and a boss 34 disposed between the grooves 33 and 36. The grooves 33 and 36 each may comprise a channel running along the length of the joining edge 30 of the structural panel 10. The boss edge 31 may further comprise sound dampening material 35 disposed one or more of the grooves 33, 36. The boss 34 may comprise a raised portion running along the length of the joining edge 30 of the structural panel 10. A boss receiving edge 32 may comprise two bosses 37 and 39, and a groove 38 disposed between the bosses 37, 39. Similarly, the boss receiving edge 32 may further comprise sound dampening material 35 disposed the groove 38. The boss receiving edge 32 may comprise a reciprocal profile of the boss edge 31, so that when the boss receiving edge 32 of one structural panel 10 and the boss edge 31 of another structural panel 10 are placed together, each boss may correspond to a groove, so that the structural panels 10 interlock.

Furthermore, as the boss edge 31 and the boss receiving edge 32 interlock, the sound dampening material 35 may substantially acoustically seal the gap between the boss edge 31 and the boss receiving edge 32. In various embodiments, the sound dampening material 35 may comprise polypropylene, although any compressible material with desired acoustical absorption properties may be used. The sound dampening material 35 may be 10 millimeter D-shaped hollow edge rubber seal weather stripping. The sound dampening material 35 compresses in response to a compression force exerted by the interlocking boss edge 31 and boss receiving edge 32 further enhancing the acoustical absorption properties.

With reference to FIGS. 1, 2, and 4A-L, the structural panel 10 may have a variety of shapes and configurations.

Referring to FIGS. 2 and 4A, the structural panel 10 may comprise a corner panel 11. The corner panel 11 may comprise the structural panel 10 having a bend disposed therein, such as a 90-degree bend to form the corner of a structure. The corner panel 11 may have any degree of bend, for example, a 30-degree bend, a 33-degree bend, a 45-degree bend, a 60-degree bend, a 66-degree bend, a 120 degree bend, or any desired bend in order to form different corners of different structures. The joining edge 30 comprising the boss edge 31 may be disposed along at least two sides of the corner panel 11. Thus, the corner panel 11 may join between at least two other structural panels 10, to form a corner in a structure. In various embodiments, four joining members 20, such as cams 21 are spaced along each boss edge 31, although any number of joining members 20 may be implemented, and optionally, a combination of both cams 21 and cam receivers 22 may be used. The joining edge 30 may also be disposed along the top edge of the corner panel 11, for example, to attach to the roof system 70 or another structural panel 10, and/or along the bottom edge of the corner panel 11, for example, to attach to the floor, or to attach to the structural panel 10 forming a floor, such as a floor/ceiling panel 14 (FIG. 4F).

Referring to FIGS. 2 and 4B, the structural panel 10 may comprise an edge panel 15. An edge panel 15 may comprise a planar profile, and have the joining edge 30 disposed along at least a top side and a bottom side of the edge panel 15, and a joining edge 30 further disposed along an inner face of the edge panel 15. In this manner, the edge panel 15 may connect to one structural panel 10 extending co-planar to the edge panel 15, and may connect to another structural panel 10 extending perpendicular to the edge panel 15. The joining edge 30 may be disposed along the top edge of the edge panel 15, for example, to attach to a roof system 70 or another structural panel 10, and/or along the bottom edge of the edge panel 15, for example, to attach to the floor, or to attach to the structural panel 10 forming the floor, such as the floor/ceiling panel 14 (FIG. 4F). In various embodiments, the joining members 20 may be spaced along each joining edge 30. Some joining members 20 may be cams 21, and some may be cam receivers 22. Some joining edges 30 may be boss edges 31 and some joining members 20 may be boss receiving edges 32.

Turning to FIGS. 2 and 4C and according to one exemplary embodiment, the structural panel 10 may comprise a three-side male, one-side female wall panel configuration ("3M1F configuration") 13. The 3M1F configuration 13 may comprise a planar profile, and have joining edges 30 disposed along all four sides of the 3M1F configuration 13. In this manner, the 3M1F configuration 13 may connect to two structural panels 10 extending co-planar to the edge panel 15, one from each side. The joining edge 30 may be disposed along the top edge of the 3M1F configuration 13, for example, to attach to a roof system 70 or another structural panel 10, and/or along the bottom edge of the 3M1F configuration 13, for example, to attach to the floor, or to attach to the structural panel 10 forming the floor, such as the floor/ceiling panel 14 (FIG. 4F).

Referring to FIGS. 2, 4B-C, and 5A-B, the joining members 20 may be spaced along each joining edge 30. Some joining members 20 may be cams 21, and some may be cam receivers 22. Some joining edges 30 may be boss edges 31 and some joining members 20 may be boss receiving edge 32. A 3M1F configuration 13 may comprise three joining edges 30 each comprising a boss edge 31, and one joining edge 30 comprising a boss receiving edge 32. The boss receiving edge 32 may be adapted to receive a boss edge 31 extending along an inner face of an edge panel 15 (or any other applicable structural panel 10) so that the edge panel 15 and the 3M1F configuration 13 extend perpendicular to one another.

With reference to FIGS. 2 and 4D, the structural panel 10 may comprise a two-side male, two-side female wall panel configuration ("2M2F configuration") 12. A 2M2F configuration 12 may comprise a planar profile, and have joining edges 30 disposed along all four sides of the 2M2F configuration 12. In this manner, the 2M2F configuration 12 may connect to two structural panels 10 extending co-planar to the edge panel 15, one from each side. The joining edge 30 may be disposed along the top edge of the 2M2F configuration 12, for example, to attach to a roof system 70 or another structural panel 10, and/or along the bottom edge of the 2M2F configuration 12, for example, to attach to the floor, or to attach to the structural panel 10 forming the floor, such as the floor/ceiling panel 14 (FIG. 4F).

Referring to FIGS. 2, 4A-D, and 5A-B, the joining members 20 may be spaced along each joining edge 30. Some joining members 20 may be cams 21, and some may be cam receivers 22. Some joining edges 30 may be boss edges 31 and some joining members 20 may be boss receiving edges 32. A 2M2F configuration 12 may comprise two joining edges 30 each comprising a boss edge 31, and two joining edge 30 comprising a boss receiving edge 32. Each boss receiving edge 32 may be adapted to receive a boss edge 31 extending from a corner panel 11 (FIG. 4A), an edge panel 15 (FIG. 4B), a 3M1F configuration 13 (FIG. 4C), or any other applicable panel, so that the structural panel 10 attached to each boss receiving edge 32 may extend outwardly co-planar to the 2M2F configuration 12.

Referring to FIGS. 1, 2, and 4F, the structural panel 10 may comprise a floor/ceiling panel 14. The floor/ceiling panel 14 may comprise a planar profile, and have joining edges 30 disposed along the inner face of the floor/ceiling panel 14. In this manner, the floor/ceiling panel 14 may connect to structural panels 10 extending perpendicular to the floor/ceiling panel 14. For instance, the floor/ceiling panel 14 may connect to the top edge of one or more structural panel(s) 10, thereby forming a roof over the structural panels 10. Alternatively, the floor/ceiling panel 14 may connect to the bottom edge of one or more structural panel(s) 10, thereby forming a floor under the structural panels 10.

With emphasis on FIGS. 2, 4F, and 5A-B, the joining members 20 may be spaced along each joining edge 30. Some joining members 20 may be cams 21, and some may be cam receivers 22. Some joining edges 30 may be boss edges 31 and some joining members 20 may be boss receiving edge 32. A floor/ceiling panel 14 may comprise three joining edges 30 each comprising a boss receiving edge 32, each joining edge 30 disposed along a different border of the inner face of the floor/ceiling panel 14. The boss receiving edges 32 may be adapted to receive boss edges 31 extending along a top or bottom of another structural panel 10, so that the floor/ceiling panel 14 is oriented perpendicular to the other structural panel(s) 10. In various embodiments, one side of the floor/ceiling panel 14 may comprise an additional joining edge 30, in order to permit the floor/ceiling panel 14 to be connected to another floor/ceiling panel 14 extending in a co-planar direction, or to a corner panel 11 (thus allowing a peaked roof to be formed), or to any other applicable structural panel 10.

Structural panels 10 may include features such as windows and doors. With expanded reference now to FIGS. 1, 2, 4A-H, the structural panel 10 may comprise a door panel 17. The door panel 17 may comprise an edge panel 15 or a 2M2F configuration 12, or a 3M1F configuration 13, or any other panel further comprising a door disposed therein. The structural panel 10 may comprise a window panel 16. A window panel 16 may comprise an edge panel 15 or a 2M2F configuration 12, or a 3M1F configuration 13, or any other structural panel 10 further comprising a window disposed therein. The structural panel 10 may comprise a window block panel 23. A window block panel 23 may comprise an edge panel 15 or a 2M2F configuration 12, or a 3M1F configuration 13, or any other panel further comprising plurality of windows disposed therein. The plurality of windows may be arranged in a pattern. For example, the pattern may comprise a straight line extending from the top to the bottom of the window block panel 23, although the pattern may also comprise any desired shape. Aspects of door panel 17, window panel 16, and window block panel 23 may be combined. For instance, a door panel 17 may also have a plurality of windows disposed therein, combining elements of door panel 17 with elements of window block panel 23.

Figure 4K:
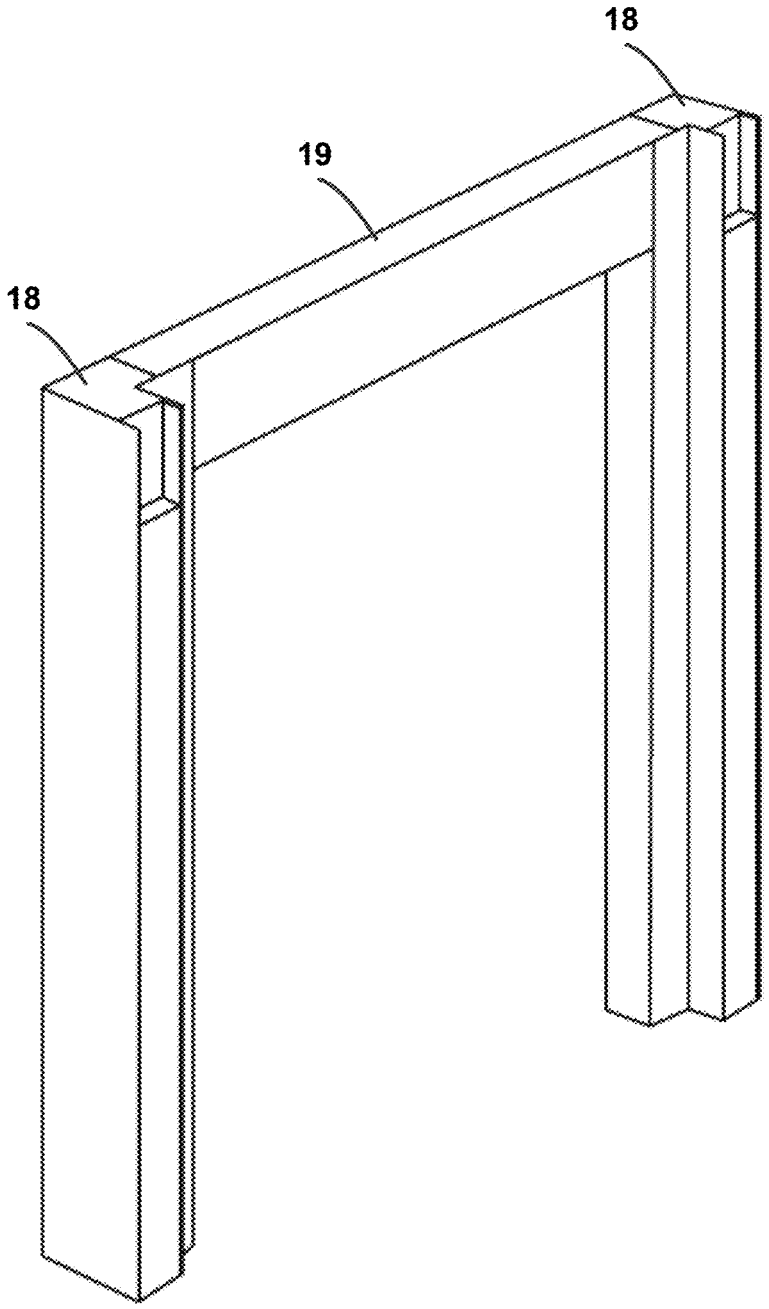
FIG. 4K is a view of an exemplary event tent structural panel comprising a transverse header panel joined with corner pillar panels, in accordance with various embodiments.
Figure 4L:
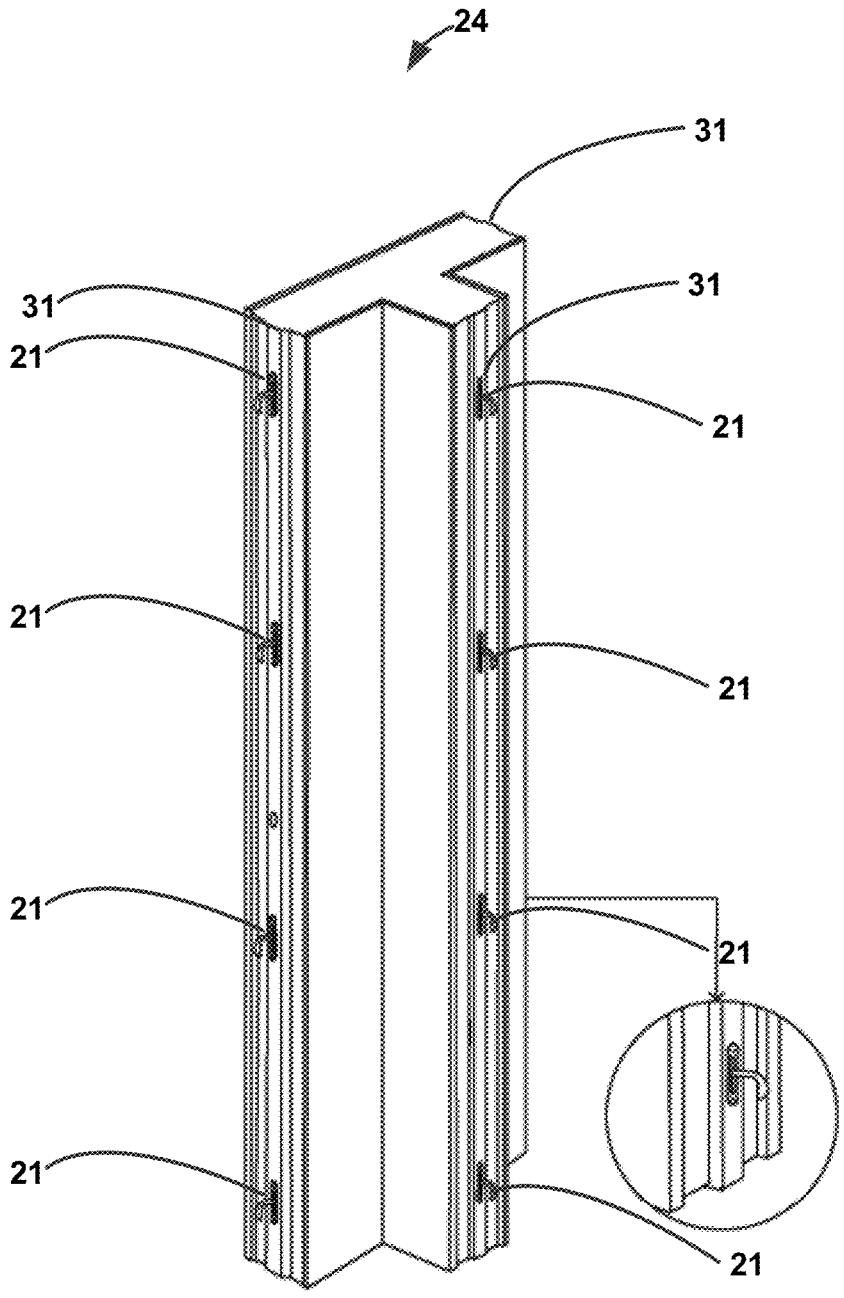
FIG. 4L is a view of an exemplary structural panel comprising a T panel, in accordance with various embodiments.

With reference to FIGS. 1, 2, 4I, 4J, 4K, and 5A-B, the structural panel 10 may comprise a corner pillar panel 18. The corner pillar panel 18 may comprise a structural panel 10 having a bend disposed therein, such as a 90-degree bend to form the corner of a structure. The corner pillar panel 18 may have any degree of bend, for example, a 30-degree bend, a 33-degree bend, a 45-degree bend, a 60-degree bend, a 66-degree bend, a 120 degree bend, or any desired bend in order to form different corners of different structures. The joining edge 30 comprising the boss edge 31 may be disposed along at least two sides of the corner panel 11. Thus, the corner panel 11 may join between at least two other structural panels 10, to form a corner in a structure. Notably however, in contrast to the corner panel 11, the corner pillar panel 18 may comprise the boss edge 31 only extending along a limited portion of each of the at least two sides of the corner pillar panel 18. Moreover, each boss edge 31 may be recessed into a notch. In this manner, a tent transverse header panel 19 (FIG. 4J) may be supported by the notch, and joined to the corner pillar panel 18 at the boss edge 31 (FIG. 4K). In various embodiments, one joining member 20, such as a cam 21 is spaced along each boss edge 31, although any number of joining members 20 may be implemented, and optionally, a combination of both cams 21 and cam receivers 22 may be used.

Turning now to FIGS. 1, 2, 4J, and 4K, the structural panel 10 may comprise a tent transverse header panel 19. A tent transverse header panel 19 may comprise a relatively narrow structural panel 10 configured to join a corner pillar panel 18 at each end. In this manner, one tent transverse header panel 19 and two corner pillar panels 18 may be assembled to form a side of an event tent 300 (FIGS. 7A-E, 8A-D, and 10A-D).

With reference to FIGS. 1, 2, 4L and 5A-B, the structural panel 10 may comprise a T-panel 24. The T-panel 24 may comprise a structural panel 10 having a portions extending in three different directions, such having two portions extending co-planar to form a planar panel (e.g., two portions extending at a 180 degree angle) with a third portion extending normal to the planar panel (e.g., a portion extending at a 90 degree angle from the planar panel) and disposed along its length, such as centered to resemble the character 'T.' In various embodiments, the T-panel 24 does not strictly resemble the character 'T', such as wherein the panel comprises a planar panel with a portion extending at an angle other than a normal angle, or wherein each portion extends in a unique direction so that no 90-degree or 180-degree angles are incorporated. Thus, in various embodiments, angles of 30-degrees, 33-degrees, 45-degrees, 60-degrees, 66-degrees, 120-degrees, 270-degrees, or any desired angle may be implemented, such as to form different corners of different structures. The joining edge 30 comprising the boss edge 31 may be disposed along least three sides of the T-panel 24. Thus, the T-panel 24 may join between at least three other structural panels 10, to form two corners in a structure. In various embodiments, four joining members 20, such as cams 21 are spaced along each boss edge 31, although any number of joining members 20 may be implemented, and optionally, a combination of both cams 21 and cam receivers 22 may be used.

Referring to FIGS. 3A-B, the internal structure 50 and its various features are now discussed in detail. As mentioned, the internal structure 50 may comprise an inner panel 51, an internal pocket 52, and/or an outer panel 53.

In various embodiments, the inner panel 51 comprises oriented strand board 54. In further embodiments, the inner panel 51 may comprise other materials, such as plastic, metal, wood, or engineered wood products. Moreover, the inner panel 51 may comprise insulating material 55. Insulating material 55 may in turn comprise a sound dampening material, such as closed cell polyurethane foam. In further embodiments, insulating material 55 may comprise any foam. Similarly, inner panel 51 may comprise alternating layers of material, such as additional layers of foam and oriented strand board.

The outer panel 53 may similarly comprise oriented strand board, metal, fiberglass, fiberglass reinforced plastic, composite plastic, and biomass fiberboard 57 among others. In further embodiments, the outer panel 53, may incorporate other materials, such as plastic, metal, wood, or engineered wood products, and may have a different material than the inner panel 51. Moreover, outer panel 53 may have an insulating material 58. Insulating material 58 may be a sound dampening material, such as closed cell polyurethane foam. In further embodiments, insulating material 58 may be any foam. Similarly, outer panel 53 may have alternating layers of material, such as additional layers of foam and oriented strand board.

The internal pocket 52 may define a void 56 between the inner panel 51 and the outer panel 53. One may appreciate that the void 56 may comprise a wire chase, or air conditioning ducting, or volume of space to locate a ballast system 100, any other desired feature. Furthermore, the void 56 may comprise additional insulating material, such as an air gap to provide thermal insulation.

A ballast system 100 may be disposed within one or more structural panel(s) 10. More specifically, the ballast system 100 may be located in the internal pocket 52 defining the void 56. The ballast system 100 may be any apparatus whereby mass may be selectably added or removed to change the weight and balance characteristics of the structural panel 10. For instance, the ballast system 100 may comprise a bladder 110, a fill inlet 120, and a drain 130. Moreover, in various embodiments, bladder 110 is omitted and a weight gaining substance is deposited directly into the internal pocket 52 defining the void 56, rather than into the bladder 110, as discussed further below.

With specific reference to FIG. 3B, bladder 110 may be a water-tight container into which water or another weight gaining substance, such as another liquid, sand, gravel, metal shot, and the like, may be poured via fill inlet 120. Bladder 110 may be a rigid container, or may be a flexible container. For example, bladder 110 may comprise a plastic membrane. Bladder 110 may comprise a polyethylene bag, or any other apparatus for retaining a weight gaining sub stance.

Figure 3C:
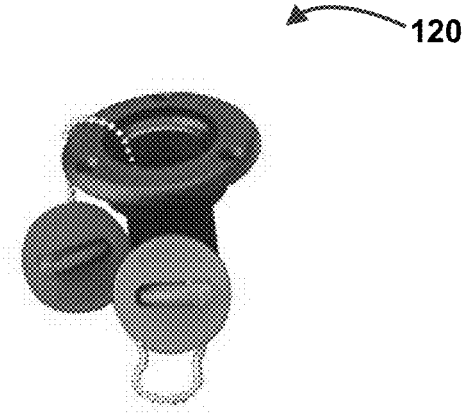
FIGS. 3C-E are views of an fill inlet of an example ballast system, in accordance with various embodiments.
Figure 3D:
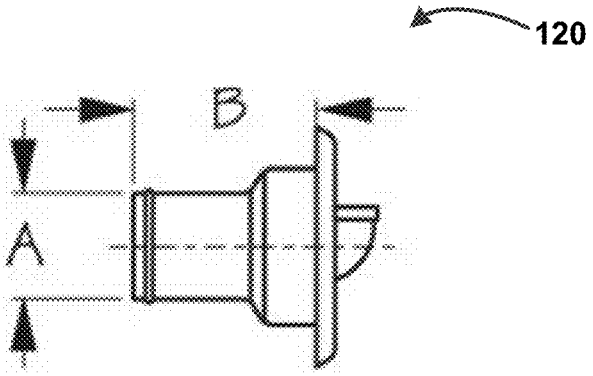
Figure 3E:
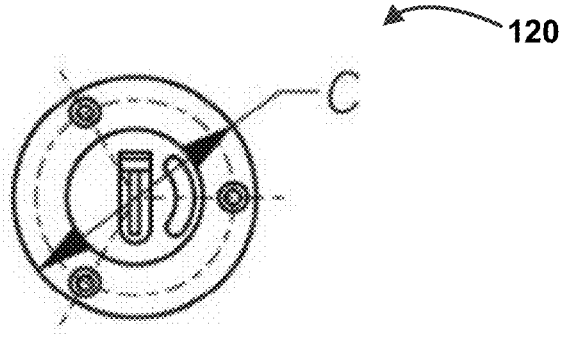

Fill inlet 120 may comprise an orifice whereby a weight gaining substance may be poured into bladder 110. Fill inlet 120 may further comprise a cap or other sealing apparatus, such as depicted in FIGS. 3C-3E. Fill inlet 120 may further have a length of tubing extending from the orifice to the bladder 110, although fill inlet 120 may also be formed integrally into the bladder 110. In various embodiments, fill inlet 120 is positioned near the top of bladder 110, so that gravity may assist the flow of weight gaining substance into the bladder 110 during filling. In further embodiments, fill inlet 120 opens directly into the internal pocket 52 defining the void 56, such as wherein the bladder 110 is omitted.

Drain 130 may comprise an orifice whereby weight gaining substance may be removed from bladder 110. Drain 130 may further have a cap or other sealing apparatus. Drain 130 may further comprise a length of tubing extending from the orifice to the bladder 110, although drain 130 may also be formed integrally into the bladder 110. In various embodiments, drain 130 is positioned near the bottom of bladder 110, so that gravity may assist the flow of weight gaining substance from the bladder 110 during draining. In further embodiments, drain 130 opens directly into the internal pocket 52 defining the void 56, such as wherein the bladder 110 is omitted.

Figure 7C:
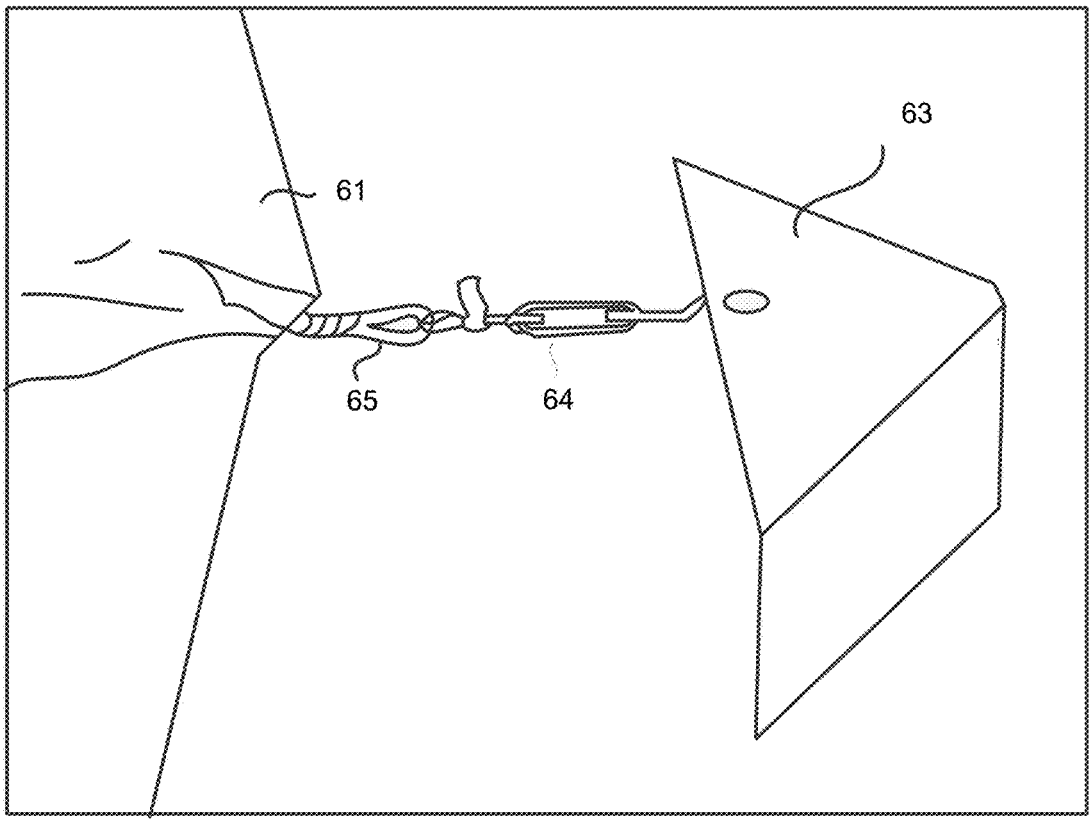
FIG. 7C is a view of various aspects of an exemplary roof of an exemplary event tent, in accordance with various embodiments.
Figure 7D:
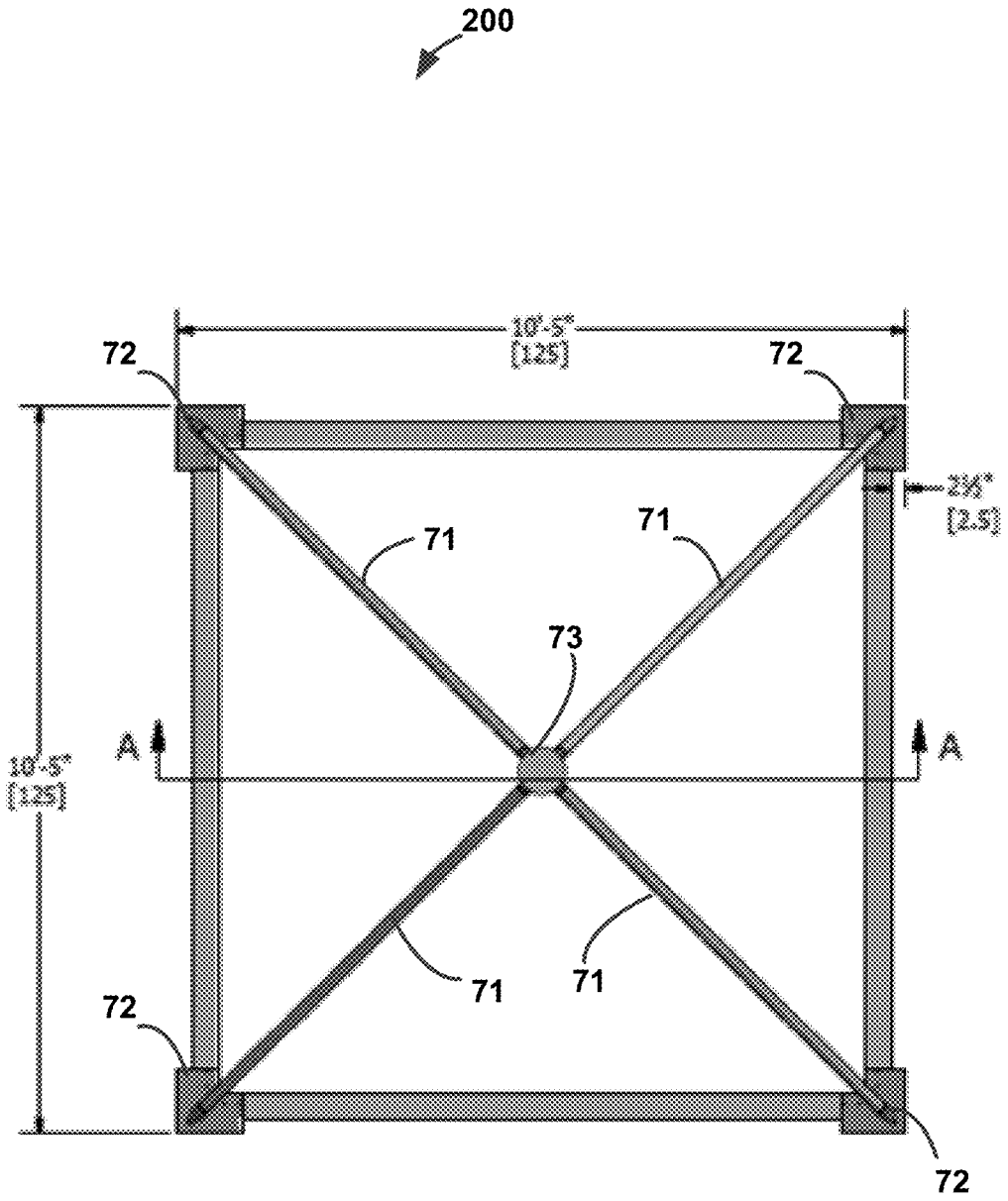
FIG. 7D is a top view of an exemplary event tent having an exemplary roof system comprising a rigid tent style roof system in accordance with various embodiments.
Figure 7E:
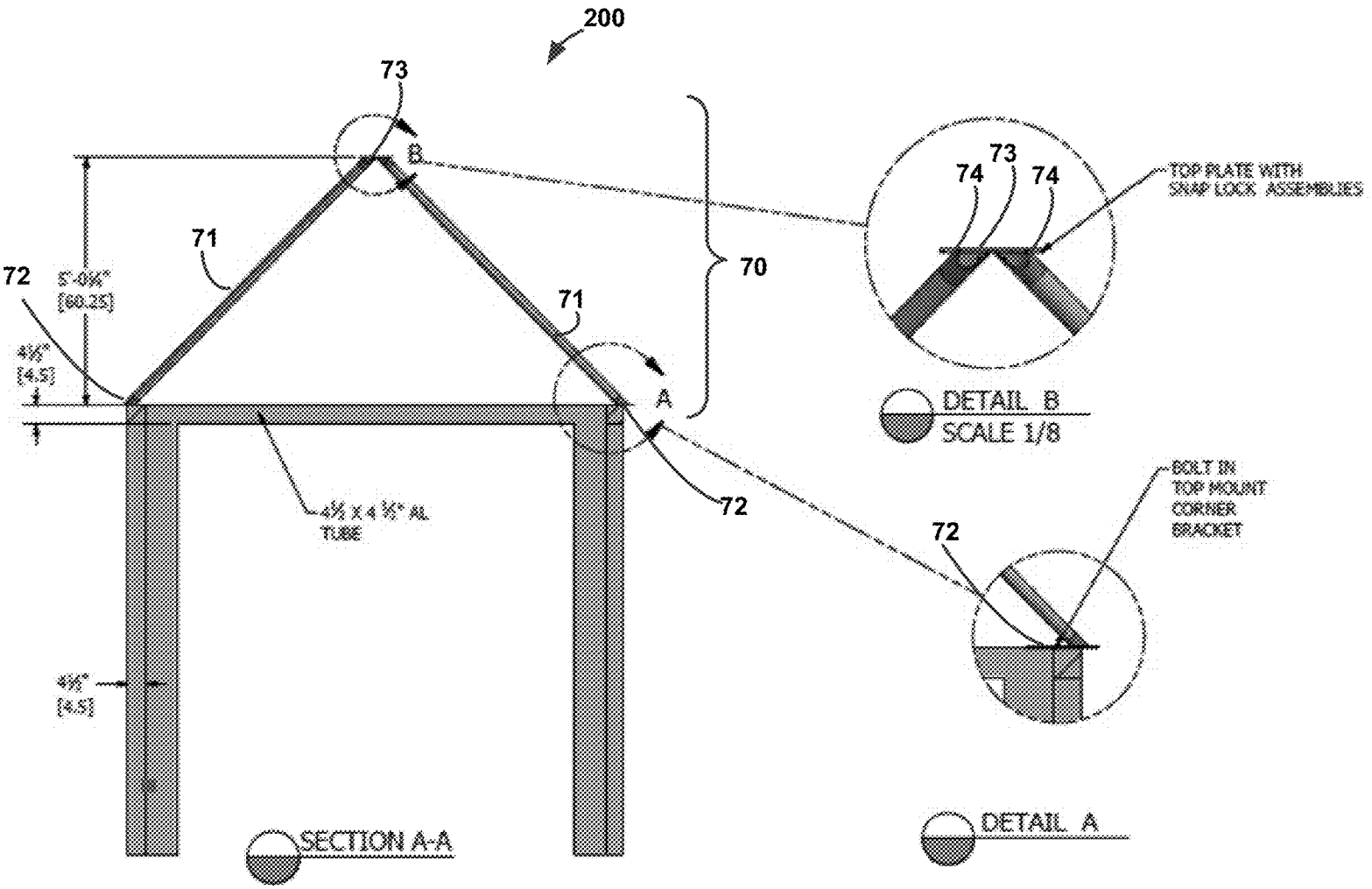
FIG. 7E is a sectional view taken along line A-A of an exemplary event tent having an exemplary roof system according to FIG. 7D and comprising a rigid tent style roof system in accordance with various embodiments.
Figure 8A:
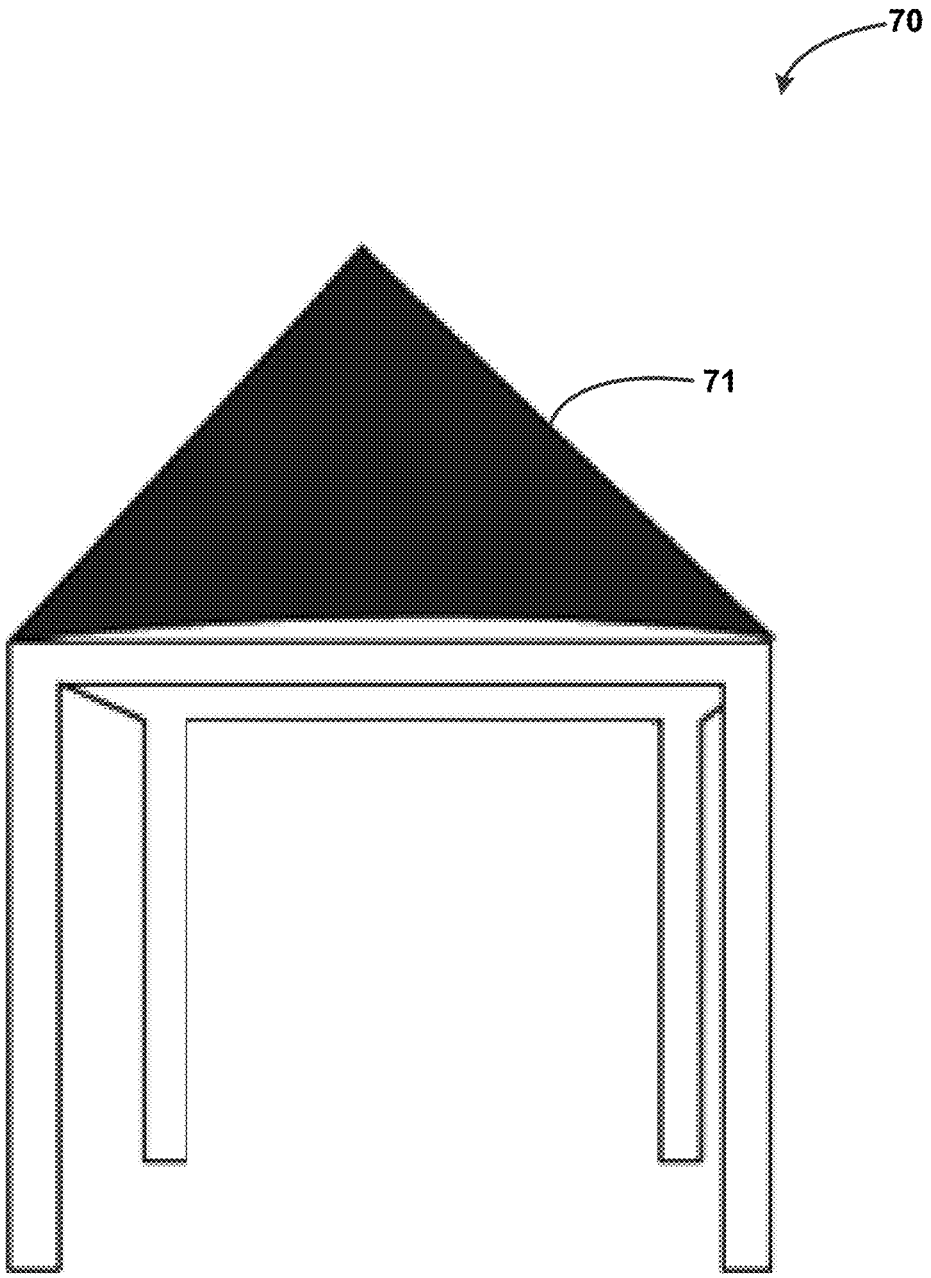
FIG. 8A is a view of an exemplary event tent having a roof system comprising a pyramid roof, in accordance with various embodiments.
Figure 8B:
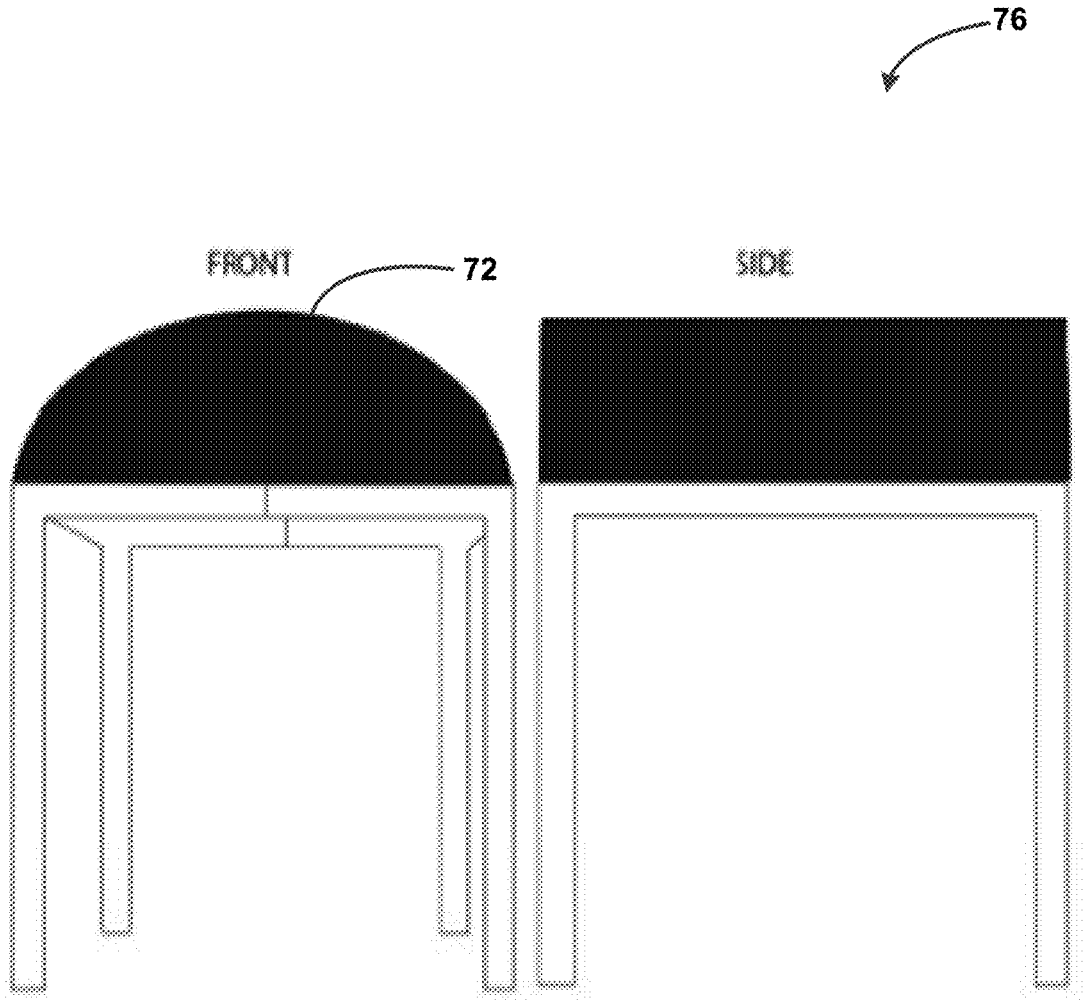
FIG. 8B is a view of an exemplary event tent having a roof system comprising a half dome roof, in accordance with various embodiments.
Figure 8C:
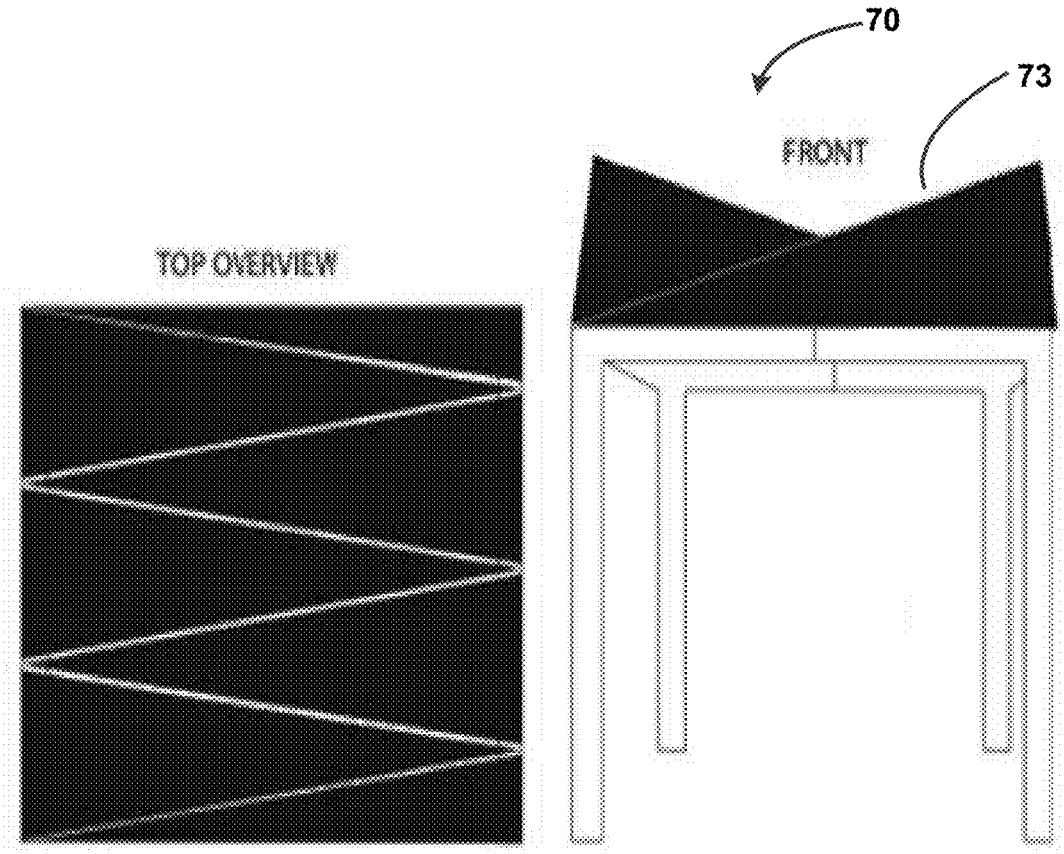
FIG. 8C is a view of an exemplary event tent having a roof system comprising a triangle staggered roof, in accordance with various embodiments.
Figure 8D:
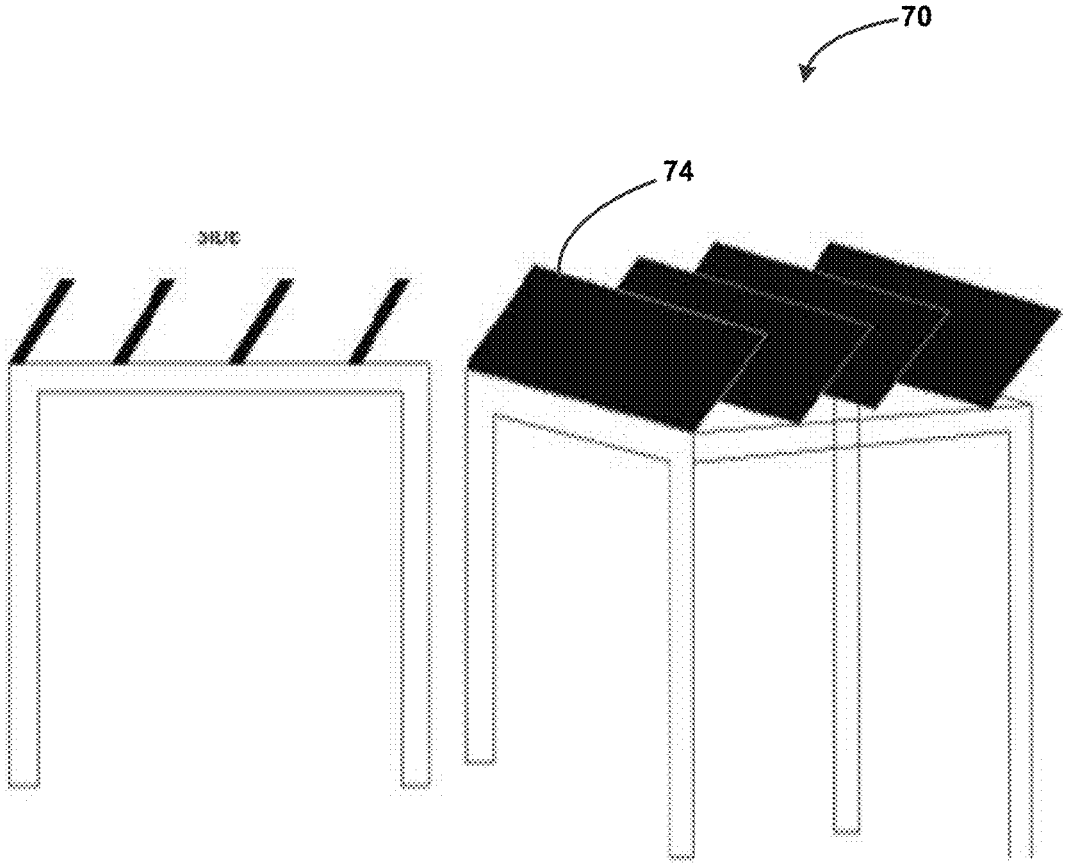
FIG. 8D is a view of an exemplary event tent having a roof system comprising a louvered panel roof, in accordance with various embodiments.

Having discussed various aspects of a demountable structure system 2 and structural panels 10, attention is directed to various aspects of the roof system 70 as shown in FIGS. 1, 7A-C, 8A-D. A demountable structure system 2 may comprise a roof system 70, which may comprise a tent style roof system (or a rigid tent style roof system) such as illustrated in FIGS. 8A-D. The tent style roof system may comprise a canvas 61, a center pole 62, corner brackets 63, turnbuckles 64, and transverse tension cables 65. The transverse tension cables 65 may comprise cables extending laterally across the top of a demountable structure system 2 from one corner to another. In various embodiments, the demountable structure system 2 comprises a structure with four corners. A transverse tension cable 65 may extend diagonally across the structure between each pair of corners. Turnbuckles 64 may be disposed at each end of each transverse tension cable 65. Each turnbuckle 64 may comprise an apparatus for adjusting the tension of the cable. For instance, each turnbuckle 64 may comprise a threaded shaft between two threaded rings, whereby the distance between the threaded rings may be set. By adjusting the distance between the threaded rings, the distance needed to be crossed by the transverse tension cables 65 may be adjusted. In this manner, the tension in each transverse tension cable 65 may be set. The transverse tension cables 65 may cross at the geometric center of the demountable structure system 2. At this intersection, a center pole 62 may be placed atop the intersection point of the transverse tension cables 65. For example, the center pole 62 may comprise slots into which the transverse tension cables 65 may slide. The transverse tension cables 65 support the center pole 62, which extends upward between the transverse tension cables 65 and the canvas 61. The canvas 61 comprises a piece of flexible material resting on top of the center pole 62 and extending downwardly to the corners of the demountable structure system 2. The canvas 61 may be fixed at the corners of the demountable structure system 2, such as by snaps, clips, hook and loop fasteners, poles, or any other appropriate mechanism. FIG. 7C shows the canvas folded back in order to reveal the turnbuckles 64, thus one may appreciate that in various embodiments, the canvas 61 does not attach to the cables, but rather attaches to the corner bracket 63, and/or the edges of various structural panels 10 of a demountable structure system 2.

With reference to FIGS. 1, 7D-E, and 8A-D, a demountable structure system 2 may comprise a roof system 70, which may comprise a rigid tent style roof system such as illustrated in FIGS. 8A-D (FIGS. 8A-D illustrate various roofs that can be made by both a tent style roof system and a rigid tent style roof system). The rigid tent style roof system may comprise a canvas (not shown, see FIG. 7A) as in the tent style roof system, roof stringer poles 71, stringer corner brackets 72, and an apex bracket 73.

The stringer poles 71 may comprise rigid poles extending upward from the top of a demountable structure system 2 from each corner and toward the center of the demountable structure system 2. In various embodiments, the demountable structure system 2 comprises a structure with four corners. A stringer pole 71 may extend diagonally across the structure toward the center of the structure, and upward from each corner. Stringer corner brackets 72 may be disposed at each corner. Each stringer corner bracket 72 may comprise an apparatus for retaining a corresponding stringer pole 71 in position atop the demountable structure system 2. The stringer poles 71 may join at an apex bracket 73 disposed at the geometric center of the demountable structure system 2 and at the peak of the roof system 70. An apex bracket 71 may comprise a plate comprising snap lock assemblies whereby each stringer pole 71 may be retained in fixed relative position. In various embodiments, the plate comprises snap lock assemblies 74, whereby the stringer corner brackets 72 are selectably attachable to the apex bracket 71. The stringer poles 71 and/or the apex bracket 73 support the canvas 61 (not shown, see FIG. 7A). The canvas 61 (not shown, see FIG. 7A) comprises a piece of flexible material resting on top of the apex bracket 71 and extending downwardly to the corners of the demountable structure system 2. In various embodiments the canvas 61 (not shown, see FIG. 7A) further rests atop the stringer poles 71. The canvas 61 (not shown, see FIG. 7A) may be fixed at the corners of the demountable structure system 2, such as by snaps, clips, hook and loop fasteners, poles, or any other appropriate mechanism.

While the roof system 70 is illustrated with respect to a pyramid shaped roof (FIG. 8A) for tent style roof systems, one may appreciate that by attaching the transverse tension cables 65 at different points, or by incorporating a different number of the elements discussed above, differently shaped roofs may be implemented such as a dome roof (FIG. 8B), a staggered triangle roof (FIG. 8C), or a louvered panel roof (FIG. 8D), among others.

With additional attention to FIGS. 10A-D a demountable structure system 2 may comprise a roof system 70, which, as mentioned, may comprise a roof comprising structural panels 10. In such embodiments, the roof may be arranged according to the principles discussed herein with respect to structural panels 10.

In further embodiments, a roof system 70 may comprise a tent style roof system in part and/or a rigid tent style roof system in part and/or a roof comprising structural panels 10 in part. Thus, various elements of various different embodiments of roof systems 70 may be combined.

Figure 9B:
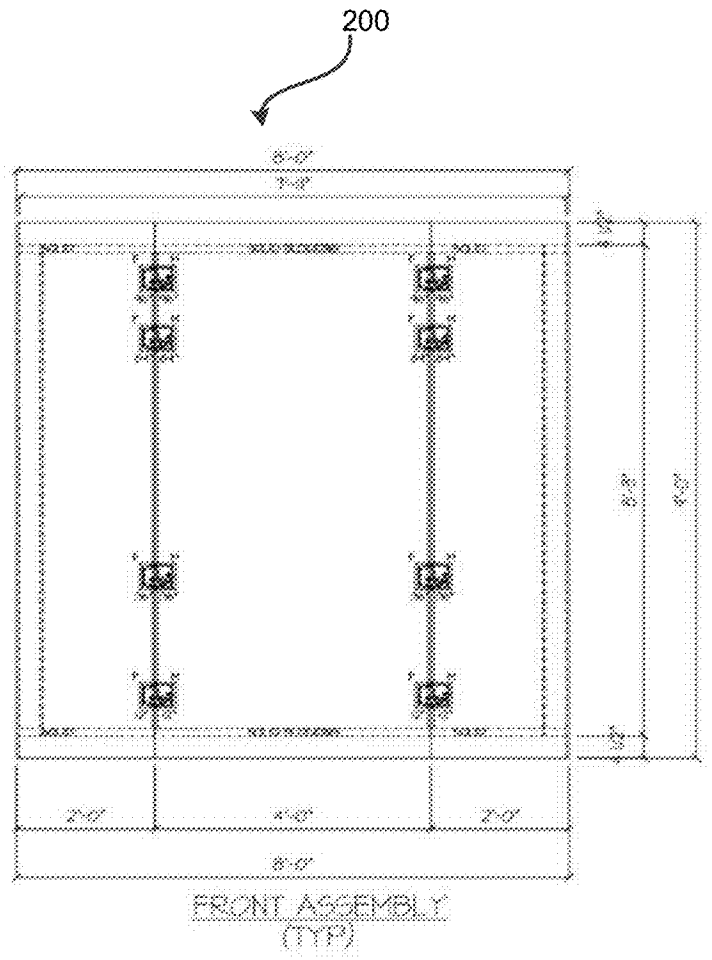
FIG. 9B is a rear view of an enclosed demountable/modular cube comprising structural panels, in accordance with various embodiments.
Figure 9A:
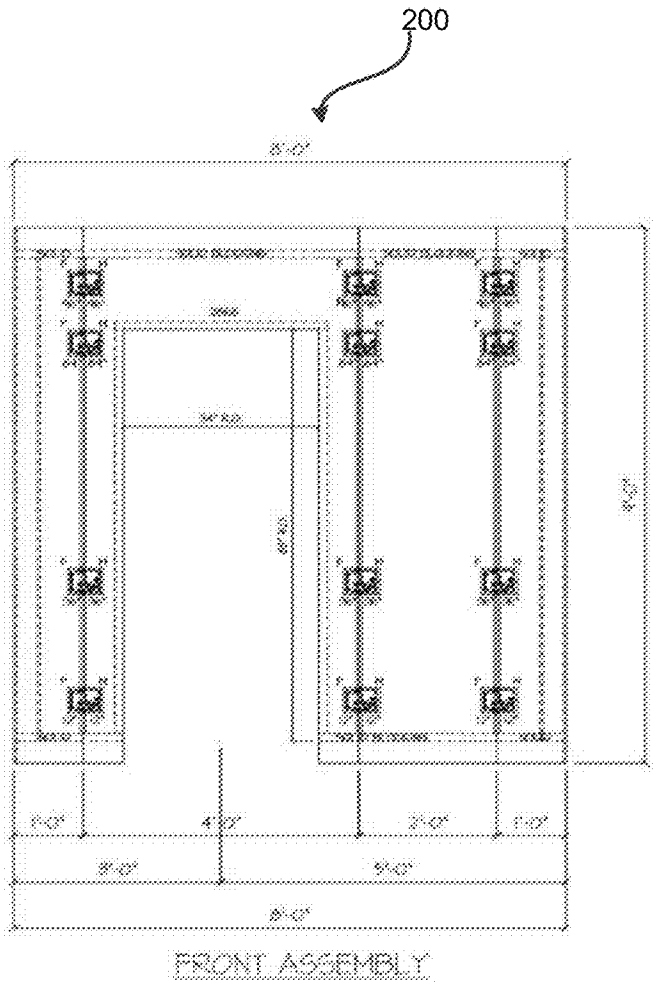
FIG. 9A is a front view of an enclosed demountable/modular cube comprising structural panels and having a door panel, in accordance with various embodiments.
Figure 9E:
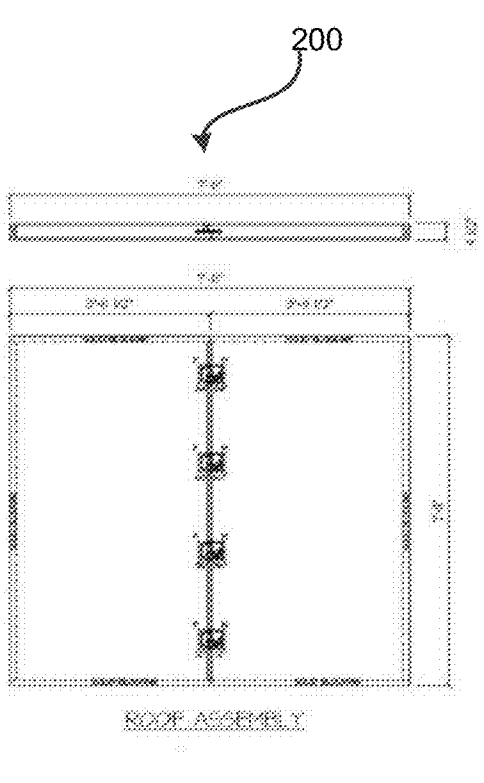
FIG. 9E is a top view of an enclosed cube comprising structural panels and depicting the roof, in accordance with various embodiments.
Figure 9D:
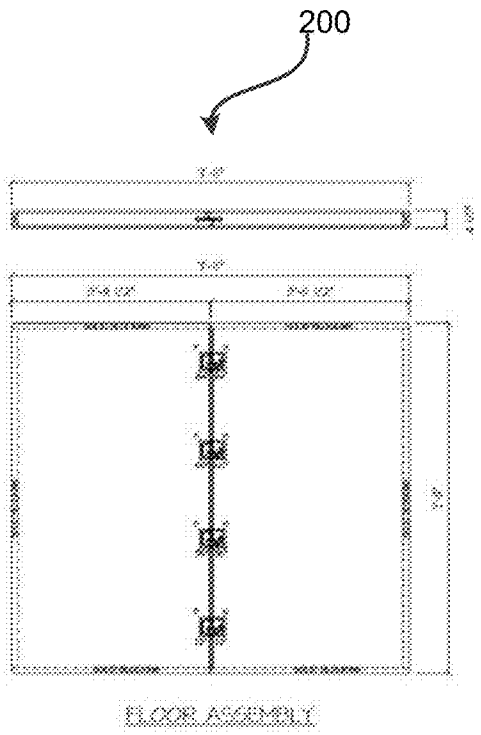
FIG. 9D is a bottom view of an enclosed demountable/modular cube comprising structural panels, in accordance with various embodiments.
Figure 9C:
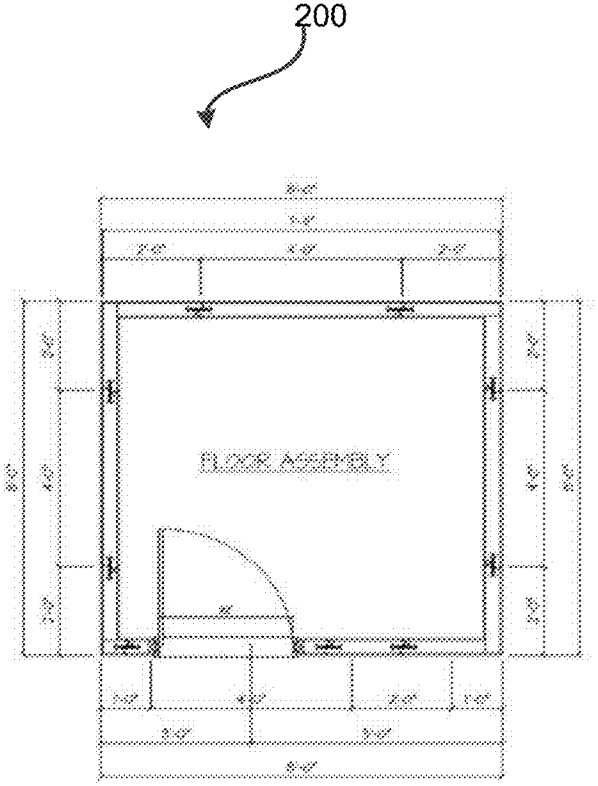
FIG. 9C is a top view of an enclosed demountable/modular cube comprising structural panels and with the roof removed, in accordance with various embodiments.

The various components discussed herein may be assembled in different ways to create different structures. With reference to FIGS. 1, 2, and 9A-E, the demountable structure system 2 may be assembled and arranged to comprise an enclosed cube 200. An enclosed cube 200 may comprise different structural panels 10, connected in a specific arrangement. For instance, FIGS. 9A-B depict 3D cross-sections of cam-locking unit placements & wall panel width sizes (corner panels 1'×1', straight panels 2' & 4' and door integrated panels). FIG. 9C depicts a 3D cross-section overhead of assembly of walls and cam-locking mechanism alignment. FIG. 3D depicts a 3D cross-section and assembly of a floor/ceiling panel and cam-locking mechanism alignment. FIG. 9E depicts a 3D cross-section and assembly of a roof system comprising a roof comprising structural panels and cam-locking mechanism alignment.

Moreover, with reference to FIGS. 1, 2 and 10A-D, the demountable structure system 2 may be assembled to comprise an event tent 300. An event tent 300 may comprise different structural panels 10, as well as a roof system 70 comprising a tent style roof system, connected in a specific arrangement. FIG. 10A-B depicts a 3D cross-section and assembly of event tent corner pillar panels with tent transverse header panels and cam-locking mechanism alignment. FIG. 10C depicts affixing an accessory device such as a television to a tent transverse header panel. FIG. 10D depicts pre-wired electrical features with outlet options including male and female inlet and outlet with plug-and-play wiring options for lighting and additional electrical accessory devices.

Figure 11A:
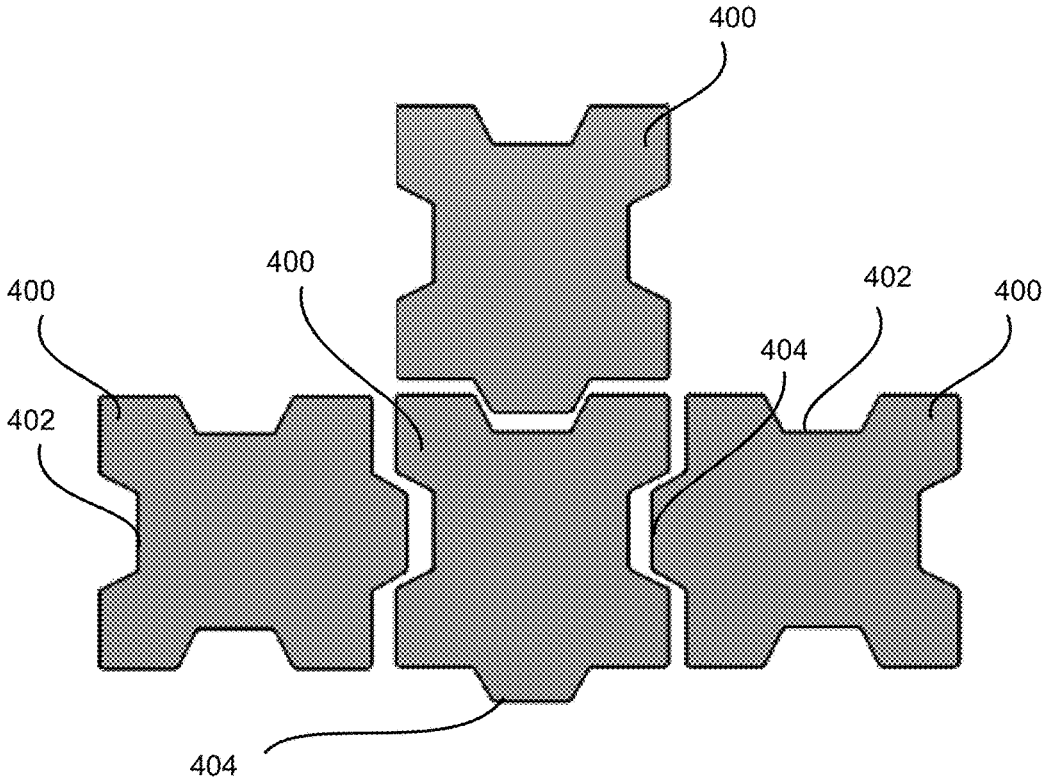
FIG. 11A is a schematic top view of four universal studs, in accordance with various embodiments.
Figure 11B:
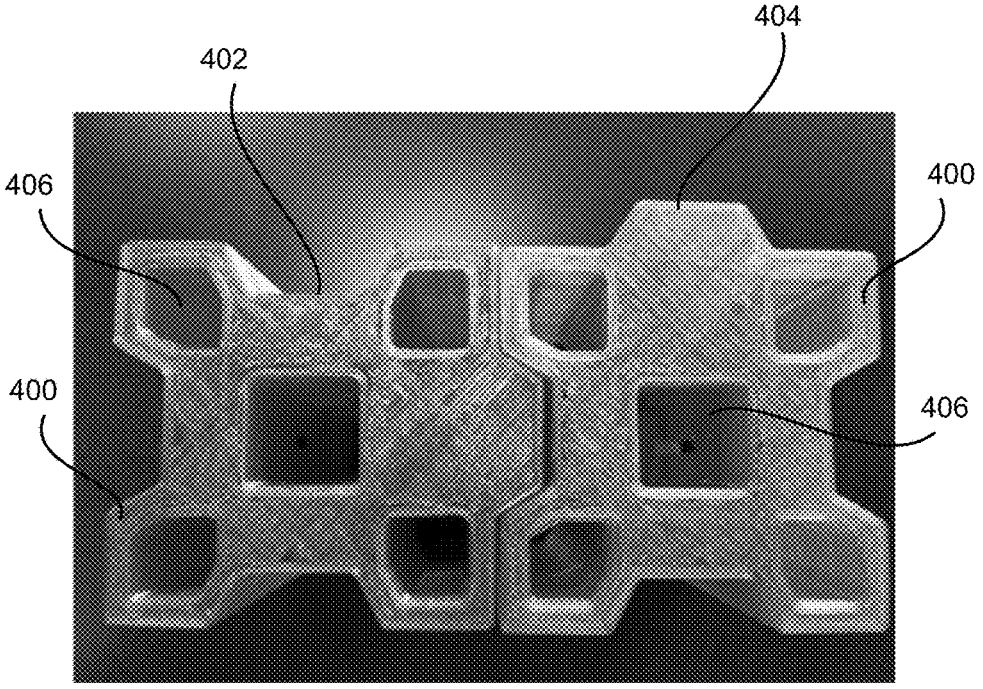
FIG. 11B is a perspective view of two universal studs, in accordance with various embodiments.

In various embodiments, and with reference to FIGS. 11A and 11B, a structural panel may comprise one or more universal studs 400. Universal stud 400 may be configured as a modular component capable of joining to one or more additional universal studs in order to construct a multi-sided panel, wall, floor, roof, or other desired structure. Universal stud 400 may be configured such that a desired structure could be assembled, disassembled, and reassembled without consideration of the location of each individual, universal stud's location in the original structure. One or more finish panels, fabric panels, and/or any other suitable panel or material (as further described herein) may be coupled to a plurality of universal studs in order to create a fully or partially enclosed structure.

Universal stud 400 may comprise at least four joining sides. In various embodiments, at least three joining sides of universal stud 400 comprise a female edge 402. Female edge 402 may comprise a groove, trough, slot, or other depression extending at least partially along the longitudinal length of a surface of universal stud 400. Female edge 402 may be configured so as to receive a complementary male edge 404. In various embodiments, at least one joining side of universal stud 400 comprises a male edge 404. Male edge 404 may comprise a boss, fin, ridge, or other projection extending at least partially along the longitudinal length of a surface of universal stud 400. Male edge 404 may be configured so as to abut a complementary female edge 402.

Female edge 402 may comprise a groove, trough, slot, or other depression having obtuse angles, such that a complementary male edge 404 may be inserted from a direction substantially normal to the joining side of the universal stud 400. However, female edge 402 and male edge 404 may comprise any shapes or angles suitable for joining a first universal stud to a second universal stud. Additional joining sides of the universal stud 400 may comprise a female edge or a male edge.

In various embodiments, universal stud 400 comprises one or more apertures 406. Aperture 406 may be oriented and extend at least partially along the longitudinal length of universal stud 400. Aperture 406 may be configured to decrease the weight of universal stud 400 without adversely affecting the structural integrity of universal stud 400. Aperture 406 may be configured to facilitate access to various portions of universal stud 400 including, without limitation, a cam lock, cam receiver, and/or cam pin.

Figure 12:
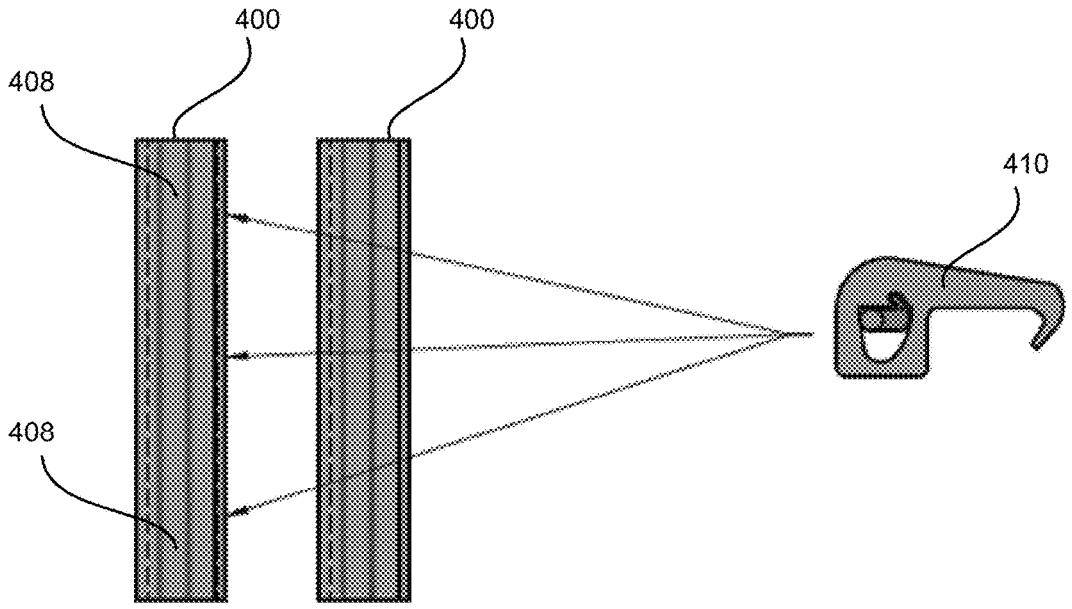
FIG. 12 is a schematic side view of two universal studs and a cam lock, showing potential locations of the cam lock on a universal stud, in accordance with various embodiments.
Figure 13A:
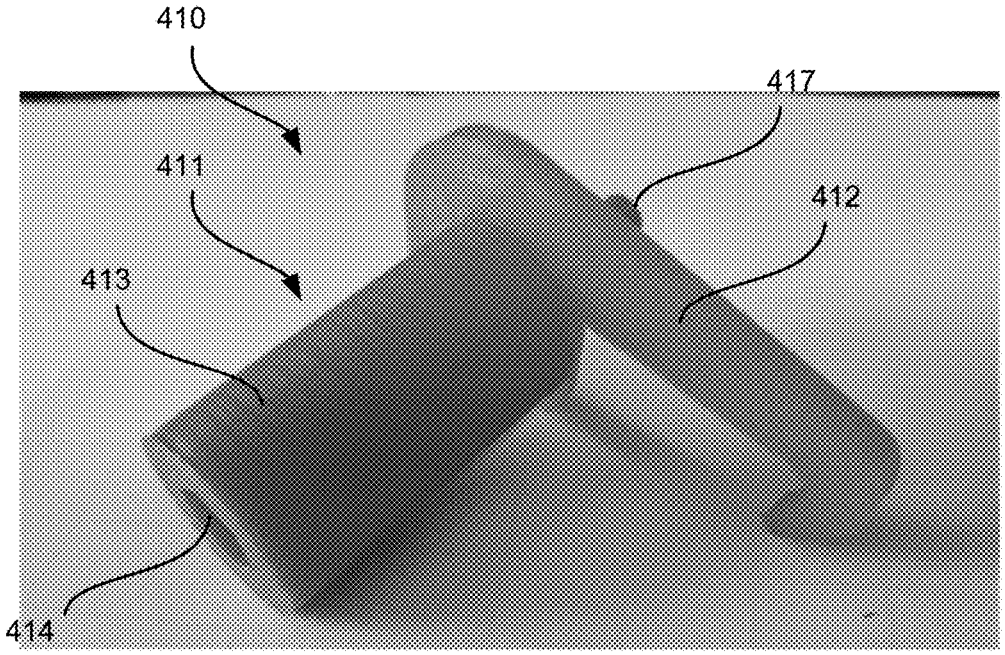
FIG. 13A is a perspective view of a cam lock, in accordance with various embodiments.
Figure 13B:
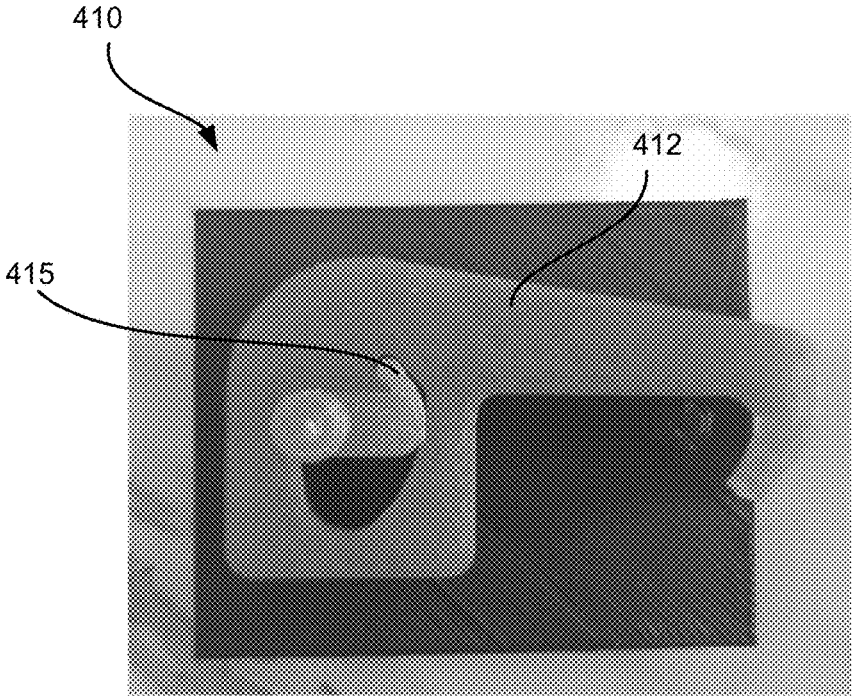
FIG. 13B is a side view of a cam lock and pin, in accordance with various embodiments.
Figure 14A:
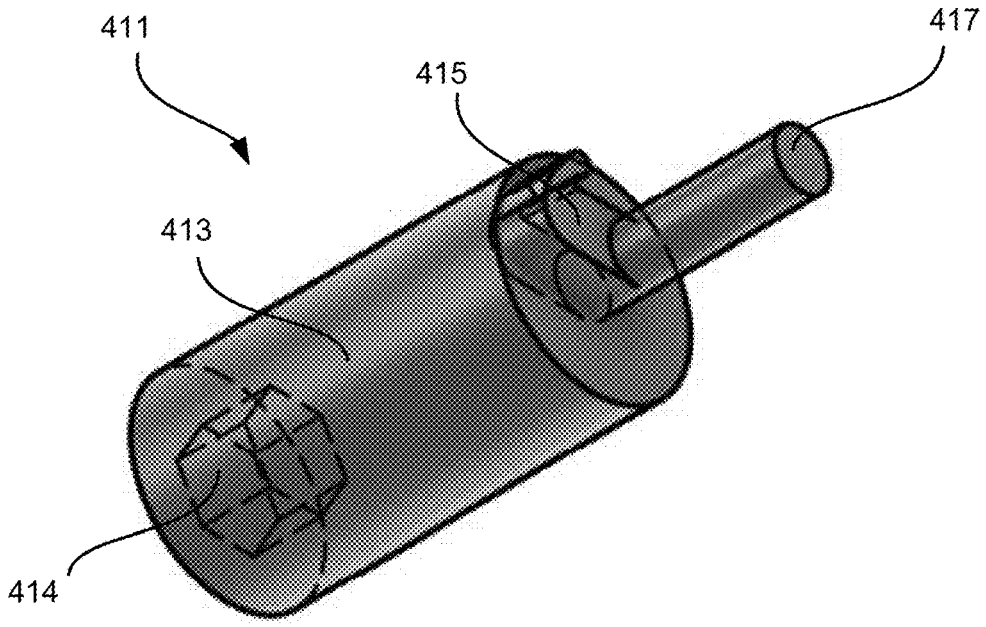
FIGS. 14A and 14B are perspective views of a cam lock, in accordance with various embodiments.
Figure 14B:
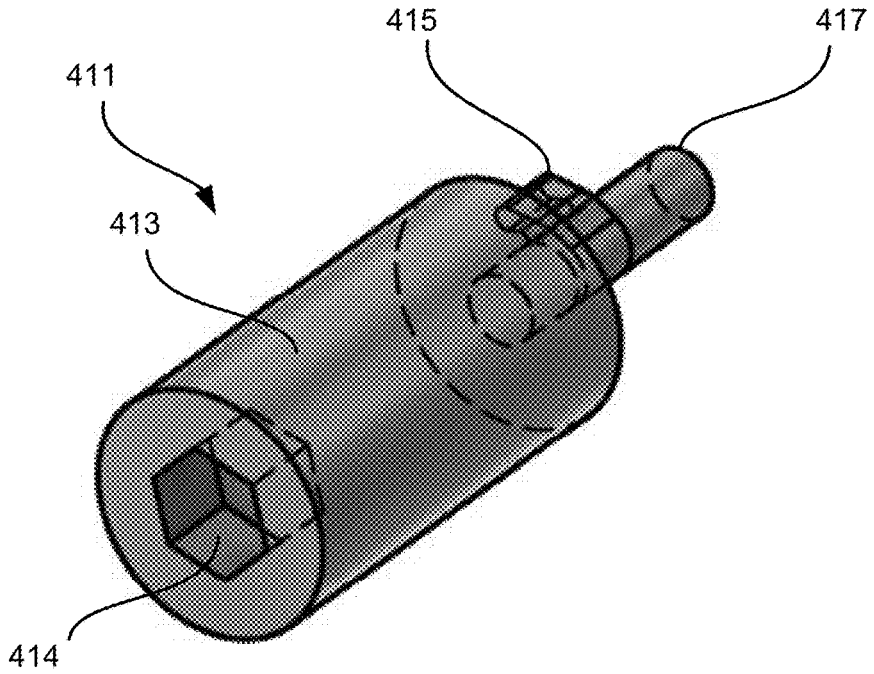

In various embodiments, and with reference now to FIG. 12, one or more cam locks 410 may be disposed along the longitudinal length of universal stud 400. A first cam lock may be disposed at the approximate midpoint of the longitudinal length of universal stud 400. A second cam lock may be disposed at or near a first end 408 of universal stud 400. A third cam lock may be disposed at or near a second end 409 of universal stud 400. One or more cam locks disposed on a first universal stud may be configured to engage with one or more cam pins (described more fully hereinafter) disposed on a second universal stud. However, any number of cam locks may be disposed on any location(s) of a first universal stud suitable for joining it to a second universal stud.

In various embodiments, and with reference now to FIGS. 13A-14B, a cam lock 410 is disclosed. Cam lock 410 may comprise a rotating base 411 and a cam hook 412. Rotating base 411 may comprise an extension member 413 and a socket 414. Socket 414 may comprise a depression or bore disposed on a first end of extension member 413. In various embodiments, socket 414 comprises a hexagonal shape complementary to an Allen wrench. However, socket 414 may comprise a triangular, square, octagonal, x-shape, or any other shape suitable to create a friction fit with a complementary rotatable tool.

In various embodiments, rotating base 411 further comprises an eccentric hook 415 and an anchor 417. Eccentric hook 415 may be disposed on a second end of extension member 413 and may comprise a hook configured to engage with an interior lip (described more fully hereinafter) of cam hook 412. In various embodiments, anchor 417 extends outwardly from the second end of extension member 413 and eccentric hook 415 is disposed to one side of anchor 417 such that, when rotating base 411 rotates, eccentric hook 415 rotates about an axis substantially parallel to the longitudinal axis of anchor 417. With momentary reference to FIG. 16, anchor 417 may be disposed in or coupled to universal stud 400 such that non-rotational movement of cam lock 410 is prevented and/or minimized.

Figure 15A:
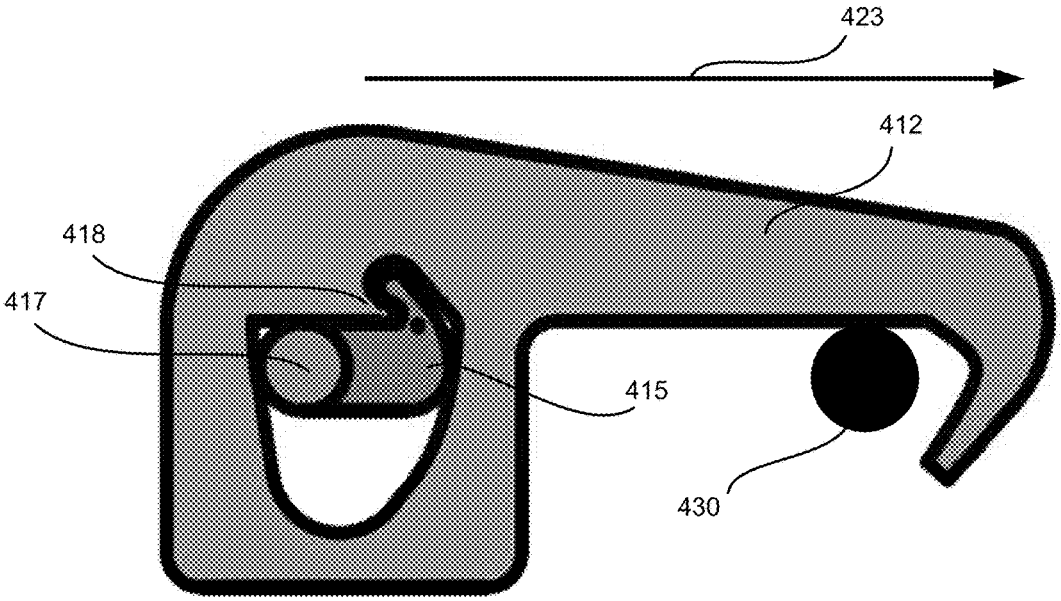
FIG. 15A is a side views of a cam lock in an unlocked position, in accordance with various embodiments.
Figure 15B:
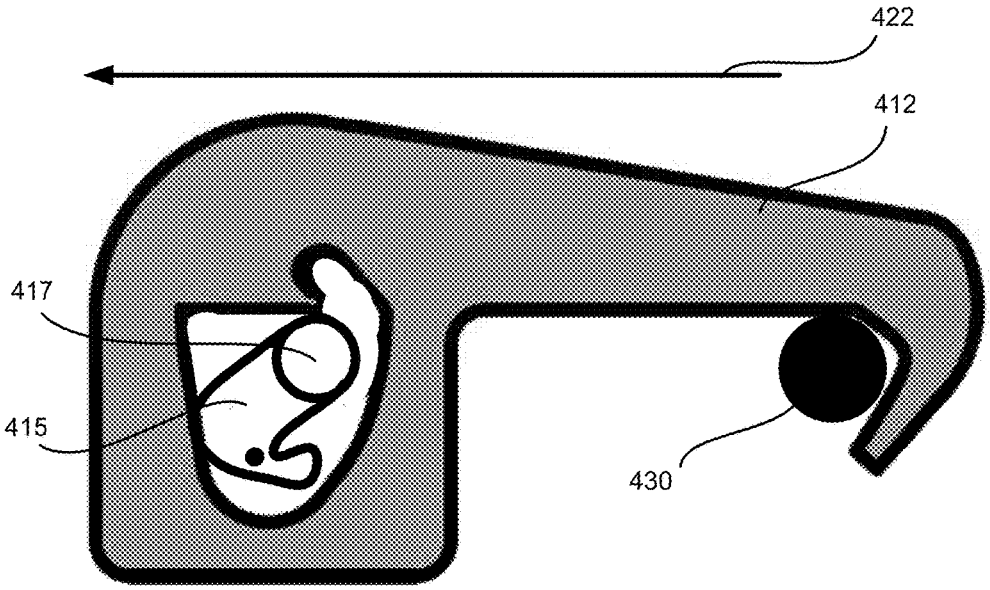
FIG. 15B is a side views of a cam lock in an unlocked position, in accordance with various embodiments.

In various embodiments and with reference now to FIGS. 15A and 15B, cam hook 412 is disposed at the second end of extension member 413. Cam hook 412 may comprise an aperture in which anchor 417 and eccentric hook 415 are at least partially disposed. Cam hook 412 may further comprise an interior lip 418 protruding from an inside edge of the aperture of cam hook 412.

In various embodiments, rotation of rotating base 411 (with momentary reference to FIGS. 14A and 14B) in a counterclockwise direction causes rotation of eccentric hook 415 in a counterclockwise direction. As used herein, all references to clockwise and counterclockwise rotation are made relative to the perspective shown in FIGS. 15A and 15B. Such counterclockwise rotation may result in engagement of eccentric hook 415 with interior lip 418 as shown in FIG. 15A. Subsequent rotation of rotating base 411 in a clockwise direction may pull cam hook in a clockwise direction until it abuts and/or engages with a cam pin 430 disposed on an adjacent universal stud.

In various embodiments, further rotation of rotating base 411 (with momentary reference to FIGS. 14A and 14B) in a clockwise direction causes rotation of eccentric hook 415 in a clockwise direction. Such rotation may cause disengagement of eccentric hook 415 from interior lip 418. Further such rotation may cause engagement of eccentric hook 415 with a first aperture edge of cam hook 412, such that cam hook 412 is translated laterally in direction 422. Lateral translation of cam hook 412 in direction 422 may cause further engagement of cam hook 412 around cam pin 430 such that counterclockwise rotation of cam hook 412 is prevented and/or a compression force is generated between adjacent universal studs.

In various embodiments, subsequent rotation of rotating base 411 (with momentary reference to FIGS. 14A and 14B) in a counterclockwise direction causes rotation of eccentric hook 415 in a counterclockwise direction. Such rotation may cause engagement of eccentric hook 415 with a second aperture edge of cam hook 412, such that cam hook 412 is translated laterally in direction 423. Lateral translation of cam hook 412 in direction 423 may cause disengagement of cam hook 412 from cam pin 430 such that a compression force between adjacent universal studs is released and the universal studs may be decoupled.

Figure 16:
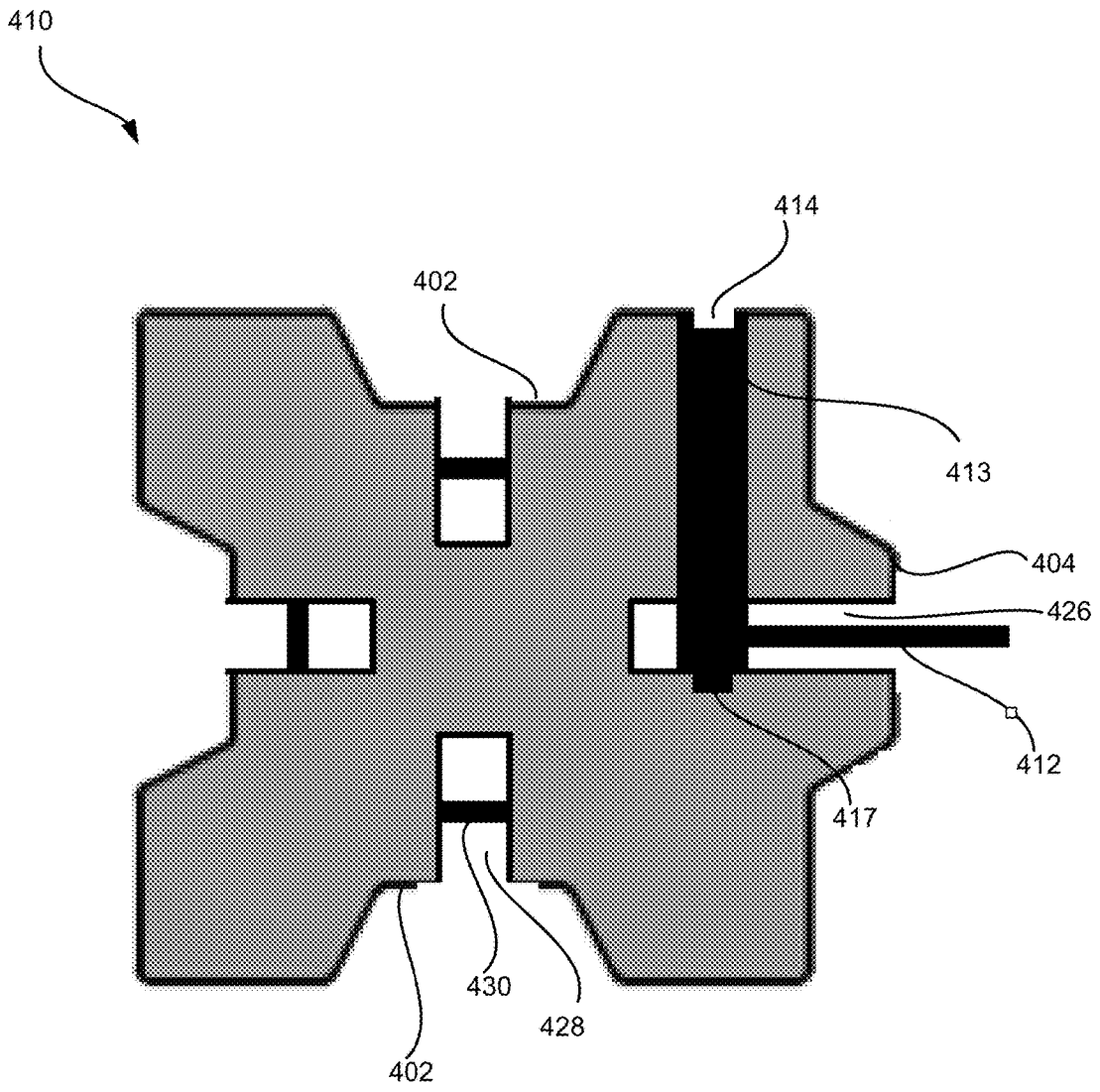
FIG. 16 is a cross sectional view of a universal stud, in accordance with various embodiments.
Figure 17A:
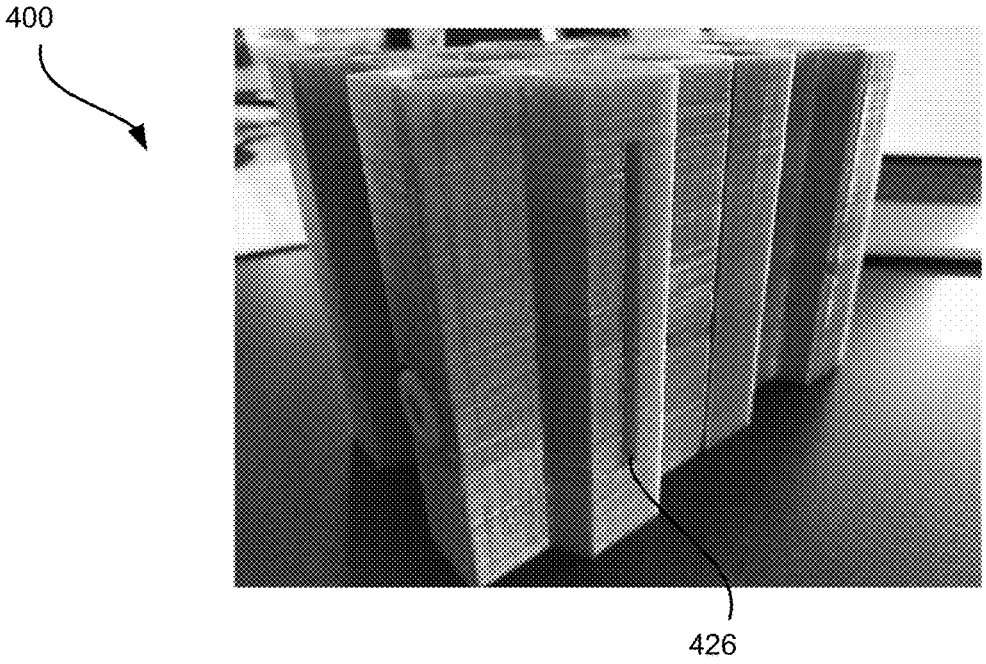
FIGS. 17A and 17B are perspective views of a universal stud, in accordance with various embodiments.
Figure 17B:
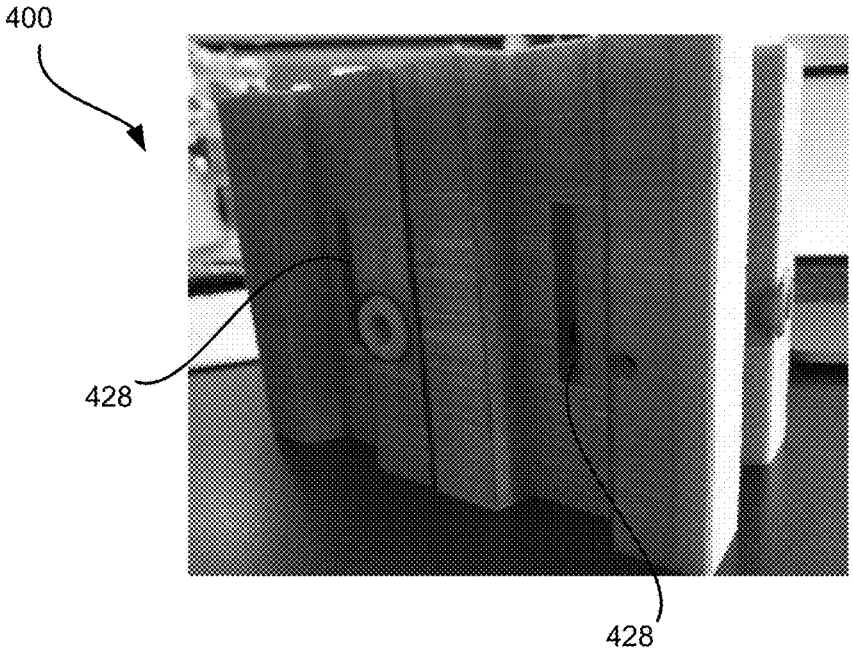

In various embodiments, and with reference to FIGS. 16-17B, cam lock 410 may be disposed at least partially within universal stud 400. Extension member 413 may comprise a suitable length and/or be configured such that socket 414 is accessible from an exterior surface of universal stud 400. Stated differently, extension member 413 may facilitate and/or improve the ease and/or speed with which a first universal stud is coupled to a second universal stud. In various embodiments, male edge 404 of universal stud 400 comprises a hook slot 426. Hook slot 426 may comprise a slot, groove, or depression disposed in a surface of male edge 404 and extending at least partially along a longitudinal length of universal stud 400. In various embodiments, cam lock 410 is disposed at least partially within universal stud 400 such that cam hook 412 is disposed at least partially within hook slot 426 such that clockwise rotation of cam hook 412 causes it to extend beyond male edge 404.

In various embodiments, female edge 402 of universal stud 400 comprises a pin slot 428. Pin slot 428 may comprise a slot, groove, or depression disposed in a surface of female edge 402 and extending at least partially along a longitudinal length of universal stud 400. In various embodiments, cam pin 430 is disposed within and sits across pin slot 428, such that engagement between cam hook 412 of a first universal stud and can pin 430 of a second universal stud causes coupling and/or compression between the first universal stud and the second universal stud.

The demountable structure system may be manufactured from various materials. The demountable structure system may comprise metal, such as aluminum, titanium, steel, or stainless steel, or composite, ceramic, ceramic matrix composite, plastics, polymers, alloys, austenitic nickel-chromium-based alloys, glass, binder, epoxy, polyester, acrylic, wood, or any material or combination of materials having a desired strength, stiffness, density, weight, or flexibility sufficient to maintain resiliency during use. In various embodiments, various portions of demountable structure systems as disclosed herein are made of different materials or combinations of materials, and/or may comprise coatings. In various embodiments the demountable structure system may be constructed primarily of wood. In further embodiments, the demountable structure system may be constructed primarily from aluminum. In other embodiments, various dimensions of various components of the demountable structure system may vary depending on the material used. For example, a demountable structure system may comprise aluminum components (e.g., structural panels) approximately 1 to 2 inches (about 2.5 to 5 cm) wider than a similar demountable structure system comprising wooden components (e.g., structural panels).

In various embodiments, demountable structure systems 2 may comprise multiple materials, or any material configuration suitable to enhance or reinforce the resiliency and/or support of the system when subjected to wear in an operating environment or to satisfy other desired weight, size, electromagnetic, chemical, physical, or biological properties, for example nonreactivity, light weight, load capacity, and heat tolerance.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may comprise a particular feature, structure, or characteristic, but every embodiment may not necessarily comprise the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", comprising", or any other variation thereof, are intended to cover a non-exclusive inclusion, such that a process, method, article, or apparatus that comprises a list of elements does not comprise only those elements but may comprise other elements not expressly listed or inherent to such process, method, article, or apparatus.

What is claimed is:

1. A demountable structure, comprising:

a plurality of universal studs, each universal stud comprising:

at least three female edges;

at least one male edge, wherein the at least one male edge is complementary to and engageable with the at least three female edges;

a cam lock, the cam lock comprising a cam hook disposed in a hook slot of the at least one male edge and a rotatable eccentric hook; and a cam pin disposed in a cam slot of at least one of the at least three female edges, wherein rotation of the eccentric hook causes rotation and lateral translation of the cam hook.

2. A universal stud, comprising:

a first female edge;

a male edge, wherein the male edge is complementary to, and configured to be engageable with an adjacent universal stud;

a cam lock, wherein the cam lock comprises:

a cam hook disposed in a hook slot of the at least one male edge, an interior lip disposed on the cam hook, and a rotatable eccentric hook disposed at least partially in an aperture defined by the cam hook, wherein the eccentric hook is configured to engage with the interior lip; and a cam pin disposed in a cam slot of the first female edge, wherein rotation of the eccentric hook causes engagement with the cam hook, rotation of the cam hook, and lateral translation of the cam hook.

3. The universal stud of claim 2, wherein the interior lip protrudes from an inside edge of the aperture.

4. The universal stud of claim 3, wherein rotation of the eccentric hook in a first rotational direction causes translation of the cam hook in a first lateral direction by application of a pushing force by the eccentric hook on the inside edge of the aperture.

5. The universal stud of claim 4, wherein rotation of the eccentric hook in a second rotational direction causes translation of the cam hook in a second lateral direction by application of a pushing force by the eccentric hook on the inside edge of the aperture.

6. The universal stud of claim 4, wherein rotation of the eccentric hook in a second rotational direction causes rotation of the cam hook in the second rotational direction by application of a pulling force by the rotatable eccentric hook on the interior lip.

7. The universal stud of claim 2, wherein the cam lock further comprises a socket disposed in a first end of an extension member, wherein the cam hook is disposed at a second end of the extension member.

8. The universal stud of claim 7, wherein the extension member is disposed in the universal stud such that the socket is accessible from an exterior surface of universal stud.

9. The universal stud of claim 2, further comprising a second female edge and a third female edge.

10. A demountable structure, comprising:

a first demountable structural panel comprising a first universal stud; and a second demountable structural panel comprising a second universal stud;

wherein each of the first universal stud and the second universal stud comprises:

a first female edge;

a male edge, wherein the male edge is complementary to, and configured to be engageable with an adjacent universal stud;

a cam lock, wherein the cam lock comprises:

a cam hook disposed in a hook slot of the at least one male edge, an interior lip disposed on the cam hook, and a rotatable eccentric hook disposed at least partially in an aperture defined by the cam hook, wherein the eccentric hook is configured to engage with the interior lip; and a cam pin disposed in a cam slot of the first female edge, wherein rotation of the eccentric hook causes engagement with the cam hook, rotation of the cam hook, and lateral translation of the cam hook.

11. The demountable structure of claim 10, wherein the first universal stud removably couples to the second universal stud.

12. The demountable structure of claim 10, wherein a sound dampening material is disposed between an exterior surface of the first demountable structural panel and an exterior surface of the second demountable structural panel.

13. The demountable structure of claim 10, wherein the first demountable structural panel comprises a first internal structure, and the second demountable structural panel comprises a second internal structure, wherein the first internal structure and the second internal structure each comprise an inner panel, an outer panel, and an internal pocket therebetween.

14. The demountable structure of claim 13, wherein the internal pocket comprises at least one of a wire chase, a ballast, an insulation material, and a sound dampening material.

15. The demountable structure of claim 14, wherein the internal pocket comprises a ballast, and wherein the ballast comprises a bladder configured to hold a liquid.

16. The demountable structure of claim 10, further comprising a demountable finish panel coupled to a first panel face of the first demountable structural panel.

17. The demountable structure of claim 10, wherein the first joining edge comprises a first electrical connector having a first connector shape and the second joining edge comprises a second electrical connector having a second connector shape that is complementary to the first connector shape, wherein the first electrical connector removably couples to the second electrical connector such that the first electrical connector is in electrical continuity with the second electrical connector.

18. The demountable structure of claim 10, further comprising a roof system.

19. The demountable structure of claim 18, wherein the roof system comprises at least one of a pyramid roof, a dome roof, a staggered triangle roof, and a louvered panel roof.

20. The demountable structure of claim 10, further comprising a second female edge and a third female edge.

* * * * *